US008168040B2

(12) United States Patent
Reinicke

(10) Patent No.: US 8,168,040 B2
(45) Date of Patent: May 1, 2012

(54) MANUFACTURE OF PAPER OR PAPERBOARD

(75) Inventor: Holger Reinicke, The Hague (NL)

(73) Assignee: BASF SE, Ludwigshafen (DE)

( * ) Notice: Subject to any disclaimer, the term of this patent is extended or adjusted under 35 U.S.C. 154(b) by 145 days.

(21) Appl. No.: 12/525,082

(22) PCT Filed: Jan. 22, 2008

(86) PCT No.: PCT/EP2008/050680

§ 371 (c)(1),
(2), (4) Date: Nov. 23, 2009

(87) PCT Pub. No.: WO2008/095769

PCT Pub. Date: Aug. 14, 2008

(65) Prior Publication Data

US 2010/0084103 A1 Apr. 8, 2010

(30) Foreign Application Priority Data

Feb. 5, 2007 (GB) ..... 0702249.4

(51) Int. Cl.
*D21H 11/00* (2006.01)

(52) U.S. Cl. ..... 162/164.6

(58) Field of Classification Search ..... 162/164.6, 162/164.1, 177

See application file for complete search history.

(56) References Cited

U.S. PATENT DOCUMENTS

| | | | |
|---|---|---|---|
| 4,385,961 | A | 5/1983 | Svending et al. |
| 4,506,062 | A | 3/1985 | Flesher et al. |
| 4,528,321 | A | 7/1985 | Allen et al. |
| 4,599,379 | A | 7/1986 | Flesher et al. |
| 4,720,346 | A | 1/1988 | Flesher et al. |
| 4,753,710 | A | 6/1988 | Langley et al. |
| 4,871,251 | A | 10/1989 | Preikschat et al. |
| 5,167,766 | A | 12/1992 | Honig et al. |
| 5,274,055 | A | 12/1993 | Honig et al. |
| 5,431,783 | A | 7/1995 | Honig |
| 5,603,805 | A | 2/1997 | Andersson et al. |
| 6,083,348 | A | 7/2000 | Auhorn et al. |
| 6,358,364 | B2 | 3/2002 | Keiser et al. |
| 6,361,652 | B2 | 3/2002 | Keiser et al. |
| 6,361,653 | B2 | 3/2002 | Keiser et al. |
| 6,391,156 | B1 | 5/2002 | Hjalmarson et al. |
| 6,395,134 | B1 | 5/2002 | Chen et al. |
| 6,451,902 | B2 | 9/2002 | Campomizzi |
| 6,616,806 | B2 | 9/2003 | Chen |
| 7,470,346 | B2 | 12/2008 | Donnelly et al. |
| 2001/0023752 | A1 | 9/2001 | Keiser et al. |
| 2003/0192664 | A1 | 10/2003 | Kulick et al. |
| 2008/0196852 | A1 | 8/2008 | Leduc et al. |
| 2009/0050282 | A1 | 2/2009 | Faucher et al. |

FOREIGN PATENT DOCUMENTS

| | | | |
|---|---|---|---|
| DE | 4436317 | A1 | 4/1996 |
| DE | 4436317 | A1 | 4/1996 |
| EP | 0 041 056 | A1 | 12/1981 |
| EP | 0 102 760 | A2 | 8/1984 |
| EP | 0 126 528 | A2 | 11/1984 |
| EP | 0 150 933 | A2 | 8/1985 |
| EP | 0 202 780 | A2 | 11/1986 |
| EP | 0 235 893 | A1 | 9/1987 |
| EP | 0 462 365 | A1 | 12/1991 |
| EP | 0 635 602 | A1 | 1/1995 |
| FR | 2 869 625 | A1 | 11/2005 |
| WO | 94/05596 | A1 | 3/1994 |
| WO | 95/23021 | A1 | 8/1995 |
| WO | 98/29604 | A1 | 7/1998 |
| WO | 00/17451 | A1 | 3/2000 |
| WO | 01/34908 | A1 | 5/2001 |
| WO | WO-2004018768 | A1 | 3/2004 |
| WO | 2004/046464 | A1 | 6/2004 |
| WO | 2004/088034 | A3 | 10/2004 |
| WO | 2005/116336 | A1 | 12/2005 |
| WO | 2007/031442 | A1 | 3/2007 |
| WO | 2007/048704 | A1 | 5/2007 |

OTHER PUBLICATIONS

English Language abstract of DE 4436317 from the esp@cenet web site printed on Sep. 21, 2009.
Great Britain Search Report dated Jun. 5, 2007.
English Language abstract of FR 2 869 625 dated Jun. 5, 2007.
Laboratory testing of retention and drainage, P87 in Leo Neimo (ed), Papermaking science and Technology, Part 4, Paper Chemistry, Fapet Oy, Jyvaskyla 1999.
"Flocculation monitoring: focused beam reflectance measurement as measurement tool", Blanco et al., Journal of chemical Engineering (229), 80(4), 734-740.
"Focused Beam reflectance measurement as a toll to measure flocculation" Blanco et al, J. chemical Engineering Department of Chemistry, papermaking conference, Mar. 2001, p. 114-126. Tappi Method T261 pm-80 Fines Fraction of Paper Stock by Wet Screening.
"Advanced wire part simulation with moving belt former and its applicability in scale up on rotogravure printing paper" Strengell K. et al, J. in Pulp and Paper Canada 105(3)(2004), T62-66.
Grossman, "Blattbildung mit Duformer® D and Pressen vom Typ 'Flexonip' bei der Herstellung von Wellpappen-Rohpapieren und Karton," Voith GMBH, Wochenblatt fur papierfabrikation (1993), 121 (19), pp. 775-6-778, 780-2.
Swleilik et al., "Bel Bai V Upgrade," Metso Paper USA, Annual Meeting, Pulp and Paper Tech. Associate of Canada, 90th, Jan. 27-29, 2004, book A A109-112.

(Continued)

*Primary Examiner* — Mark Halpern
(74) *Attorney, Agent, or Firm* — Drinker Biddle & Reath

(57) ABSTRACT

A process of making paper or paperboard with improved ash retention relative to total retention comprising the steps of providing a thick stock cellulosic suspension that contains filler, diluting the thick stock suspension to form a thin stock suspension, in which the filler is present in the thin stock suspension in an amount of at least 10% by weight based on dry weight of thin stock suspension, flocculating the thick stock suspension and/or the thin stock using a polymeric retention/drainage system, draining the thin stock suspension on a screen to form a sheet and then drying the sheet, in which the polymeric retention/drainage system comprises, i) a water-soluble branched anionic polymer and ii) a water-soluble cationic or amphoteric polymer, wherein the anionic polymer is present in the thick stock or thin stock suspension prior to the addition of the cationic or amphoteric polymer. The process brings about improved ash retention relative to total retention.

16 Claims, 11 Drawing Sheets

OTHER PUBLICATIONS

Search Report dated Jul. 10, 2007, issued by UK Intellectual Property Office in British application No. GB0702248.6.

Duoformer TQv. Voith trade publication P. 376 e 4000 Jun. 2002.

Twogether—Magazin fur Papiertechnik (issue 6(1998), Bock et al. (in German).

Triple Star-Sappi Gratkom GMBH, Voith trade publication p. 316 e, Jun. 1998, 4000 p. 7, col. 2, paragraph 3, figure 8.

Tappi Method T261 cm-94 "Fines Fraction of Paper Stock by Wet Screening".

Figure 1: Measurement and calculation principle of total fines reduction (TFR)
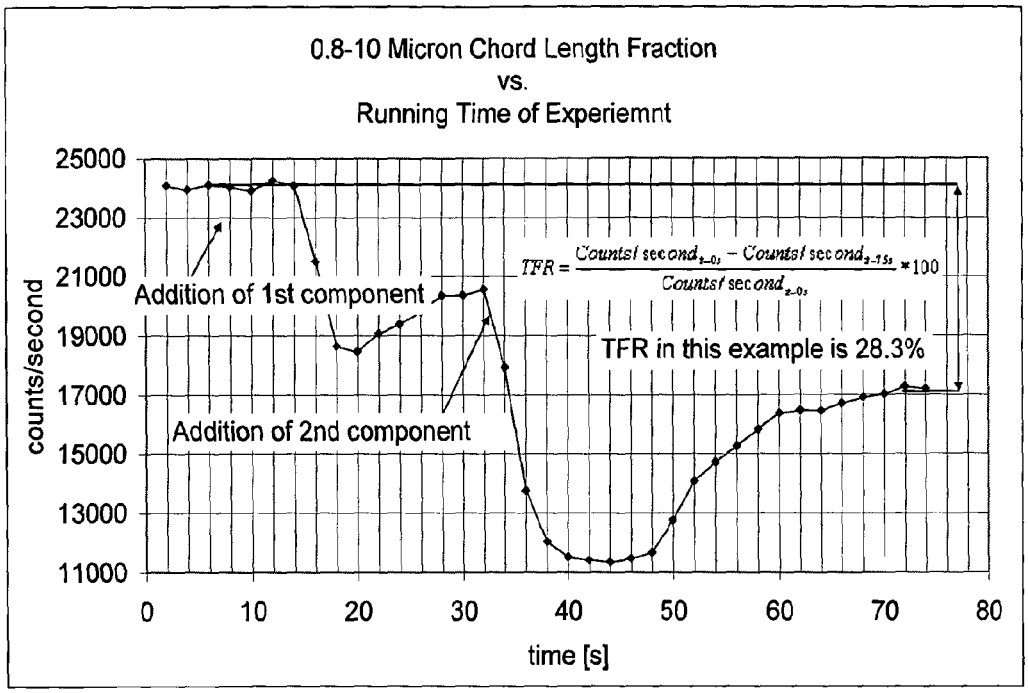
Figure 2: Fine paper furnish with system A. Ash over basis weight
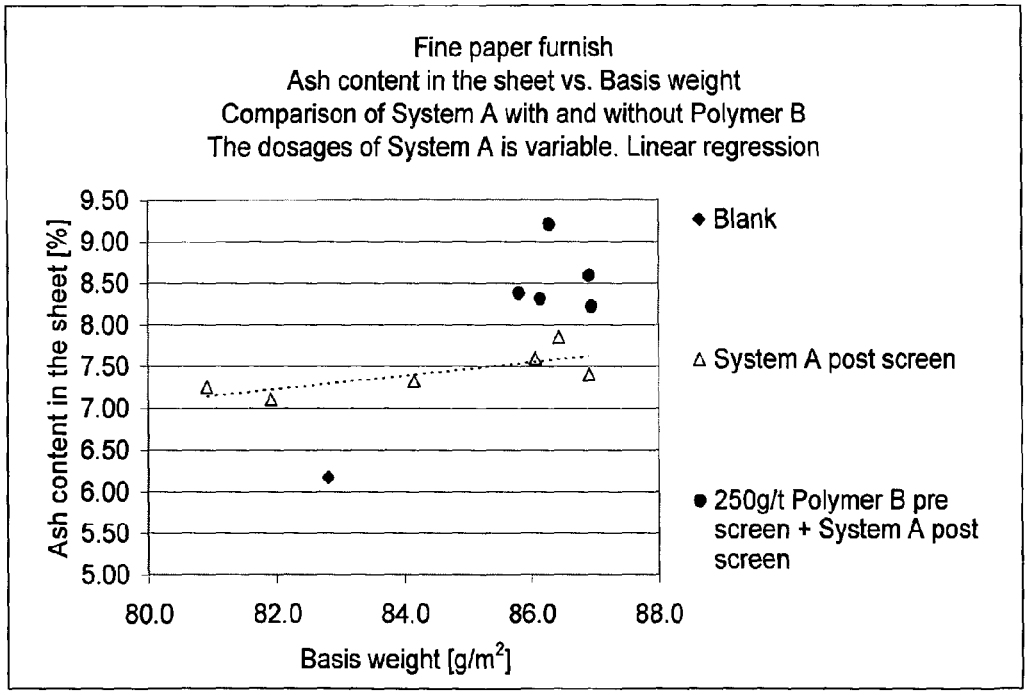

Figure 3: Fine paper furnish with system B. Ash over basis weight
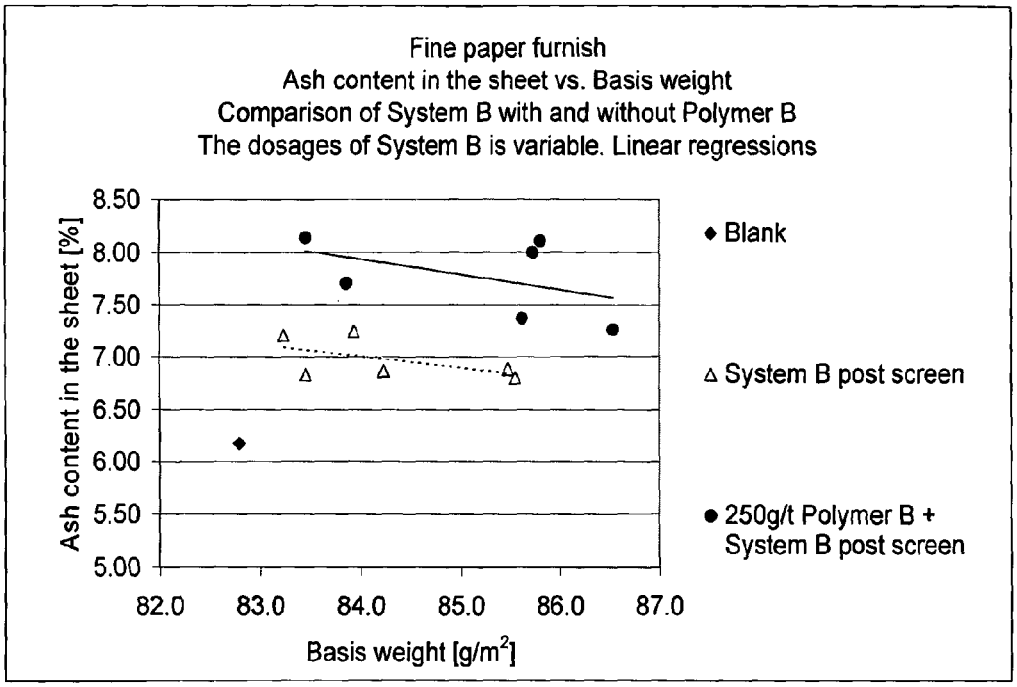
Figure 4: Mechanical furnish 1 with system A. TFR over basis weight
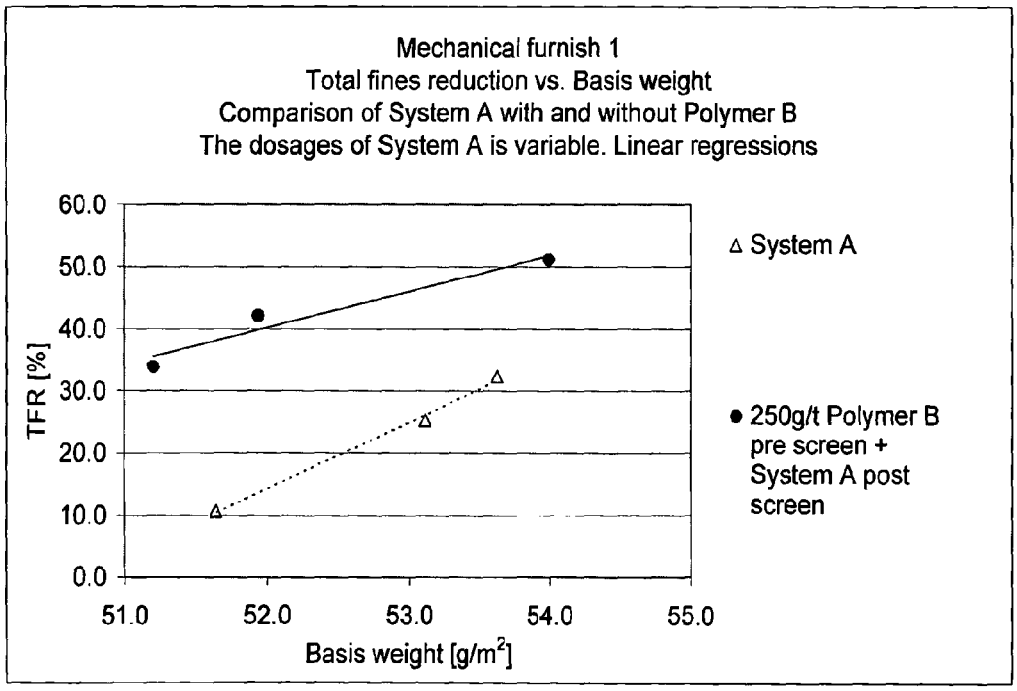

Figure 5: Mechanical furnish 1 with system A. Ash over basis weight
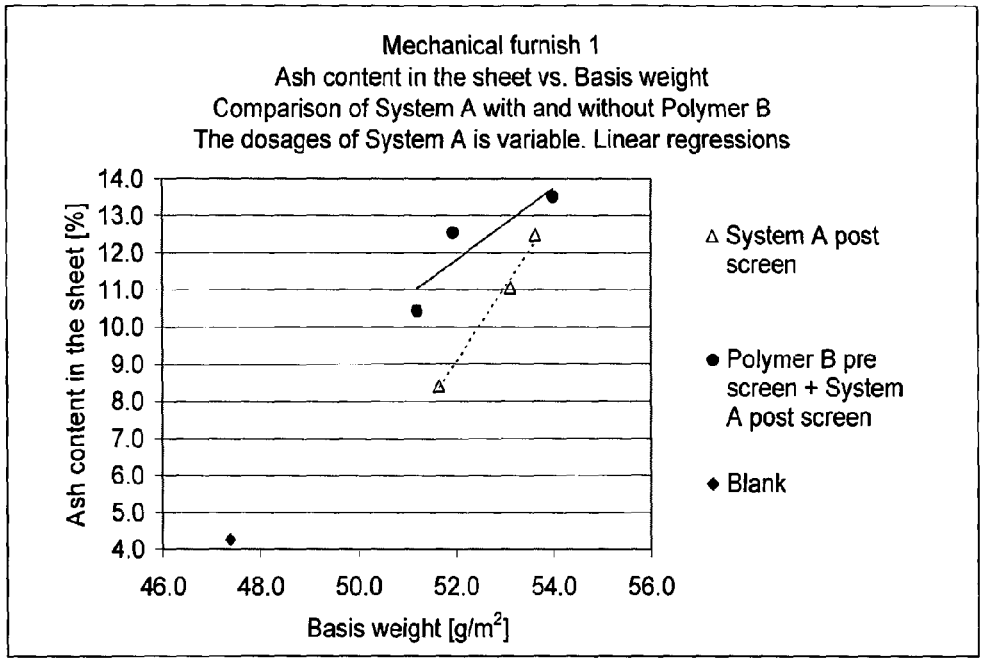
Figure 6: Mechanical furnish 2 with system A. TFR over basis weight
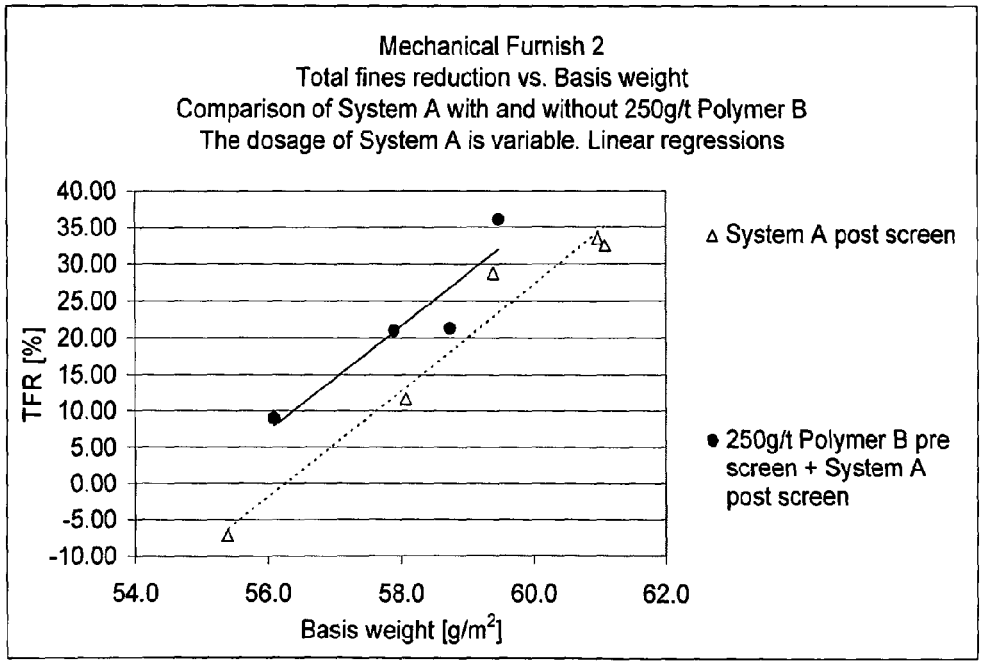

Figure 7: Mechanical furnish 2 with system B. TFR over basis weight
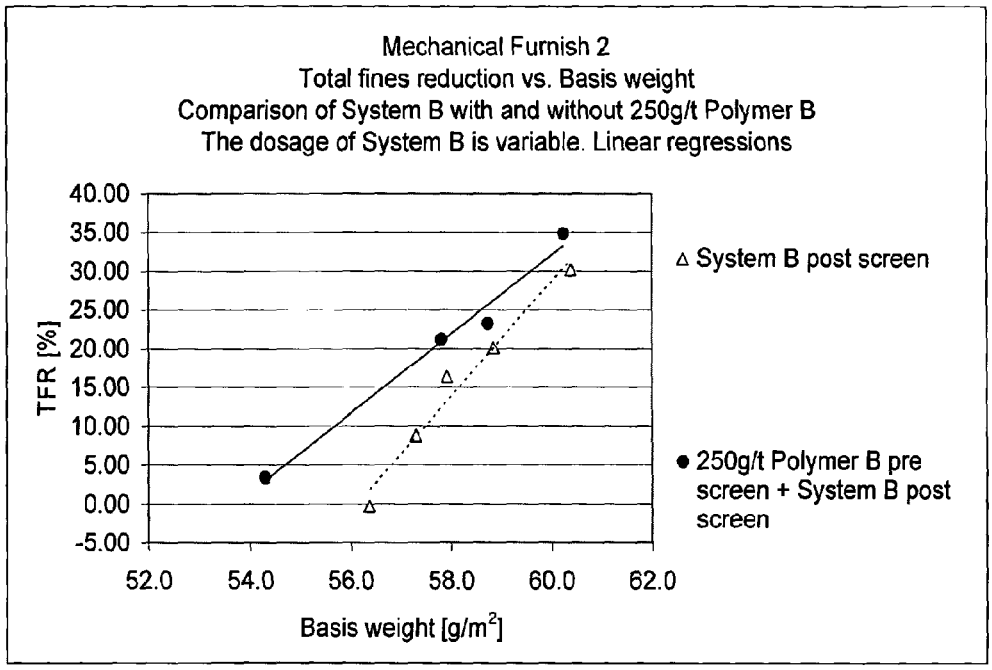
Figure 8: Mechanical furnish 2 with system A. Ash over basis weight
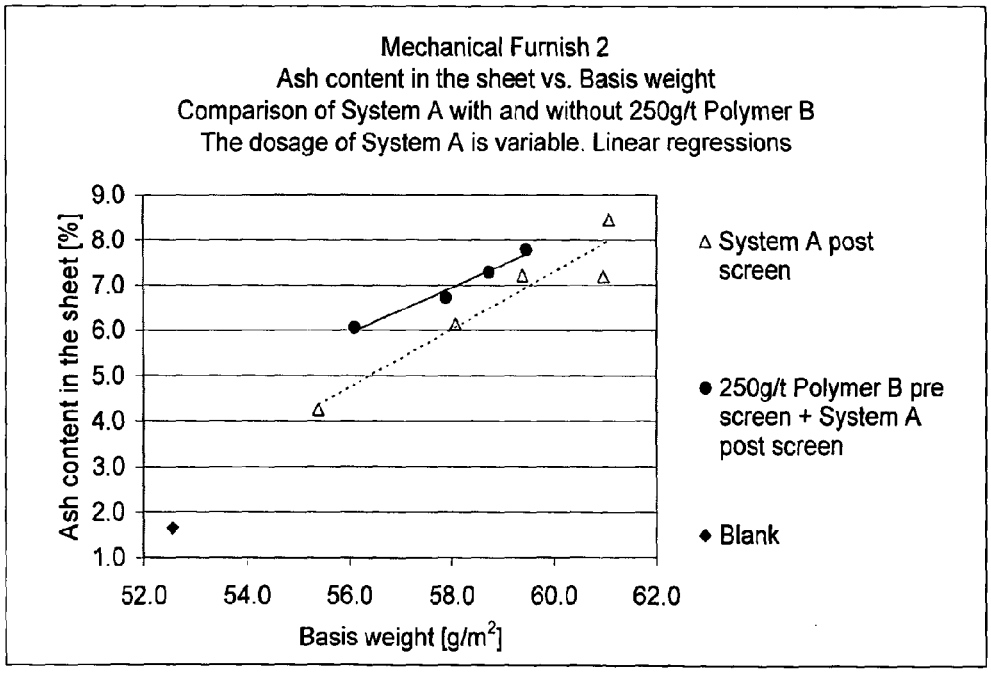

Figure 9: Mechanical furnish 2 with system B. Ash over basis weight
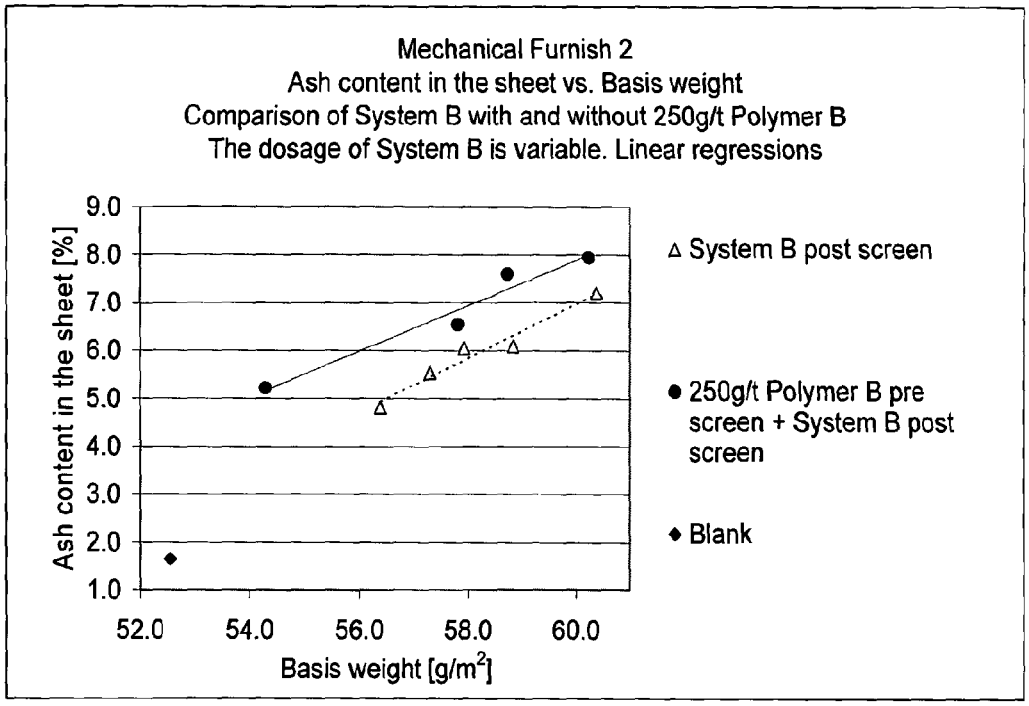
Figure 10: Mechanical furnish 3 with systems A and D. Ash over basis weight
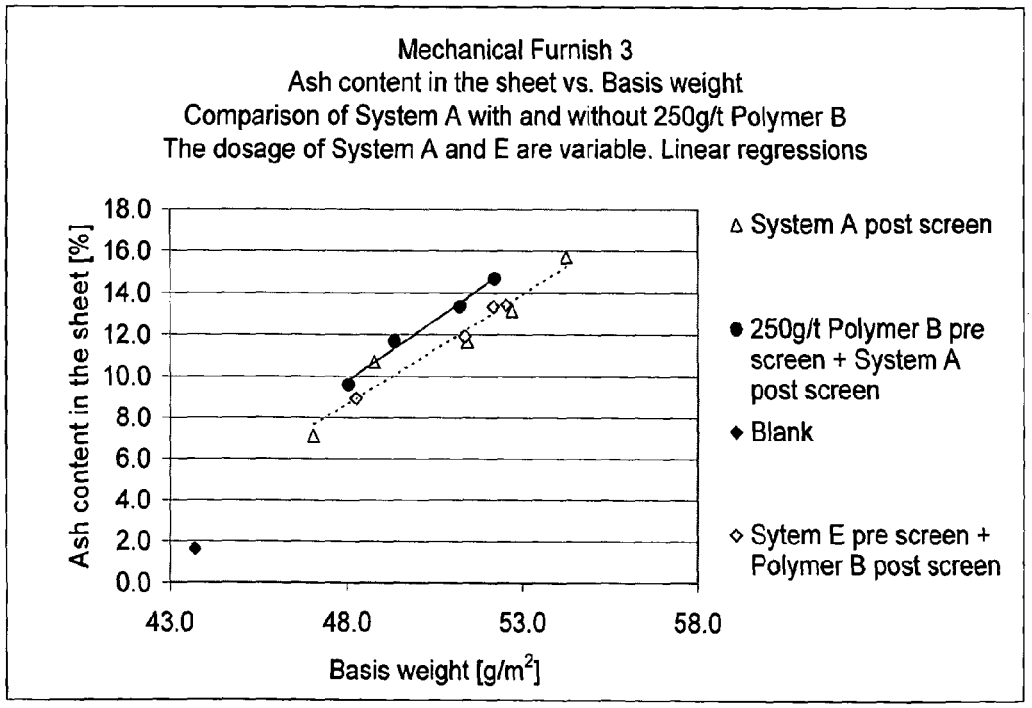

Figure 11: Mechanical furnish 3 with systems C and E. TFR over basis weight
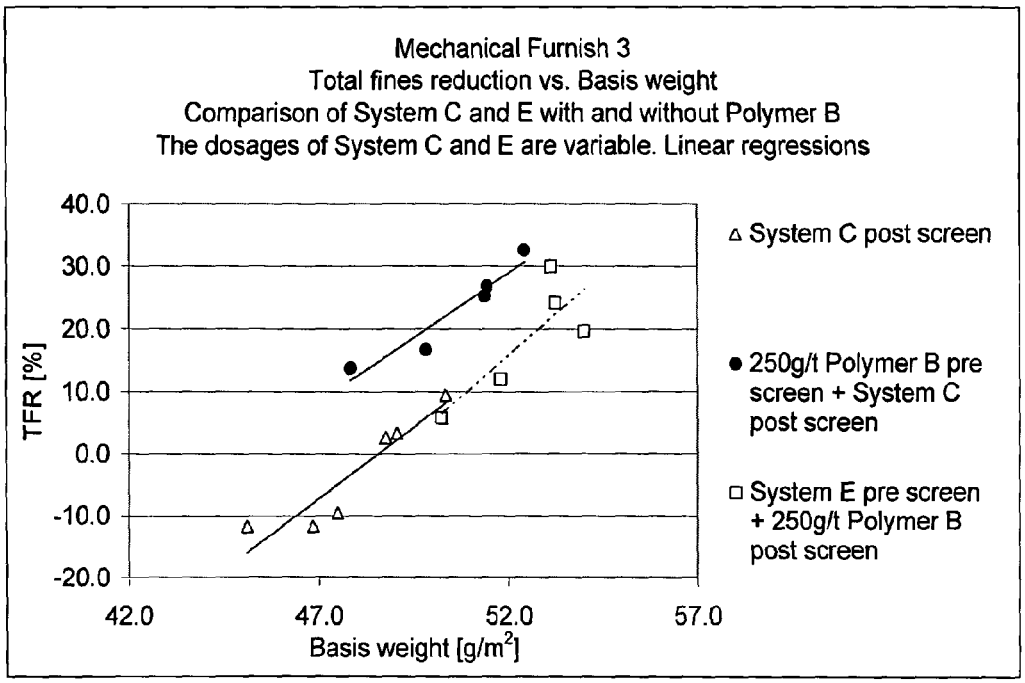
Figure 12: Mechanical furnish 3 with system C and E. Ash over basis weight
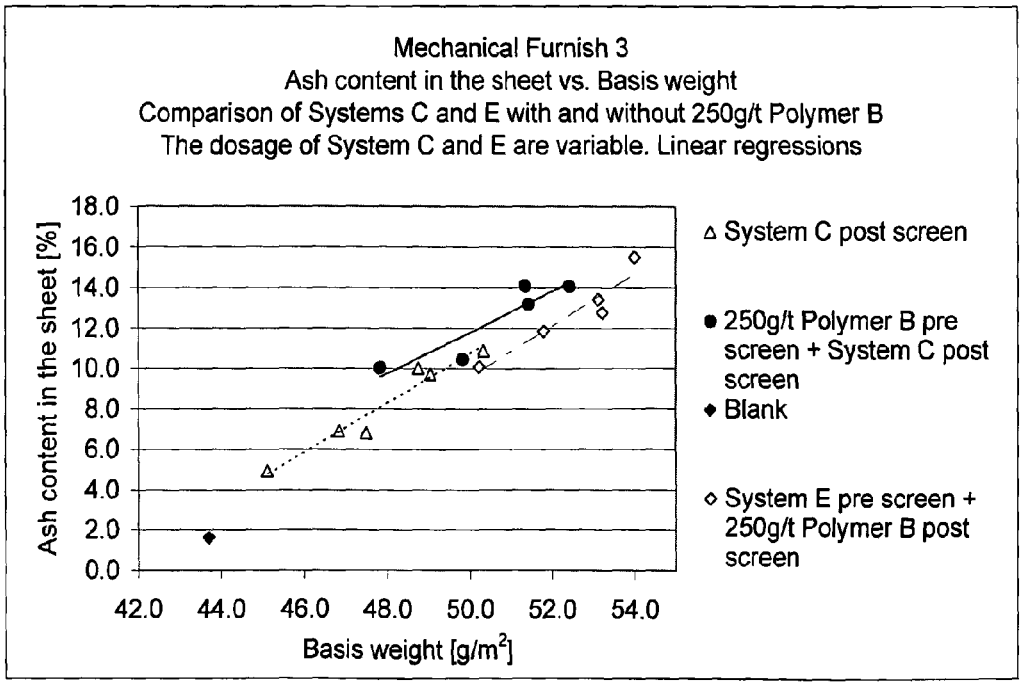

Figure 13: Mechanical furnish 4 with system A. TFR over basis weight
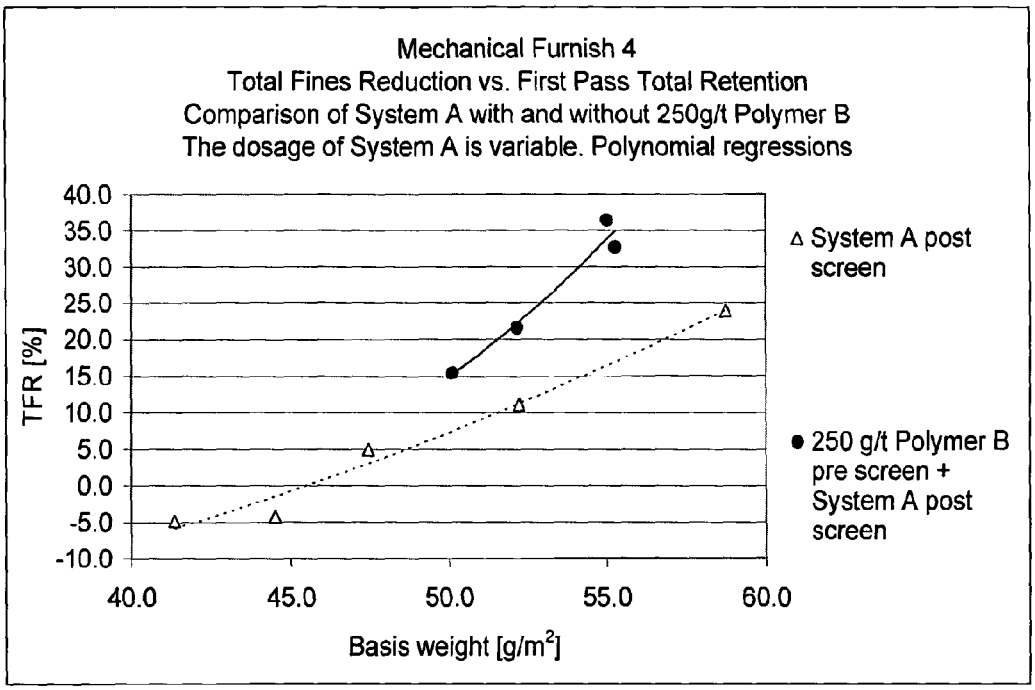
Figure14: Mechanical furnish 4 with system B. TFR over basis weight
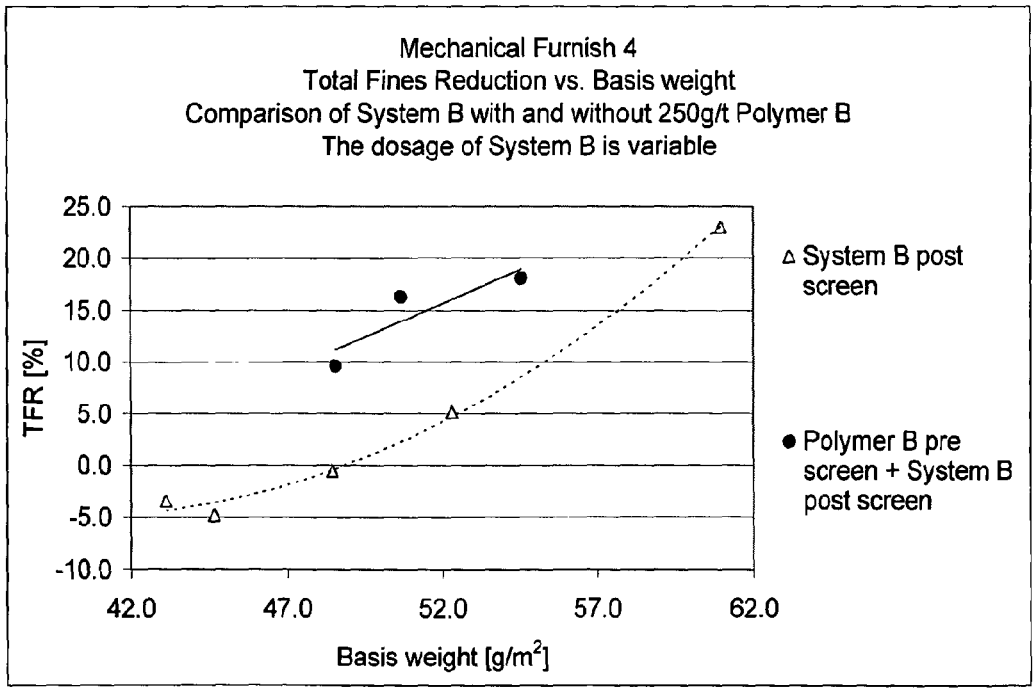

Figure 15: Mechanical furnish 4 with system A. Ash over basis weight
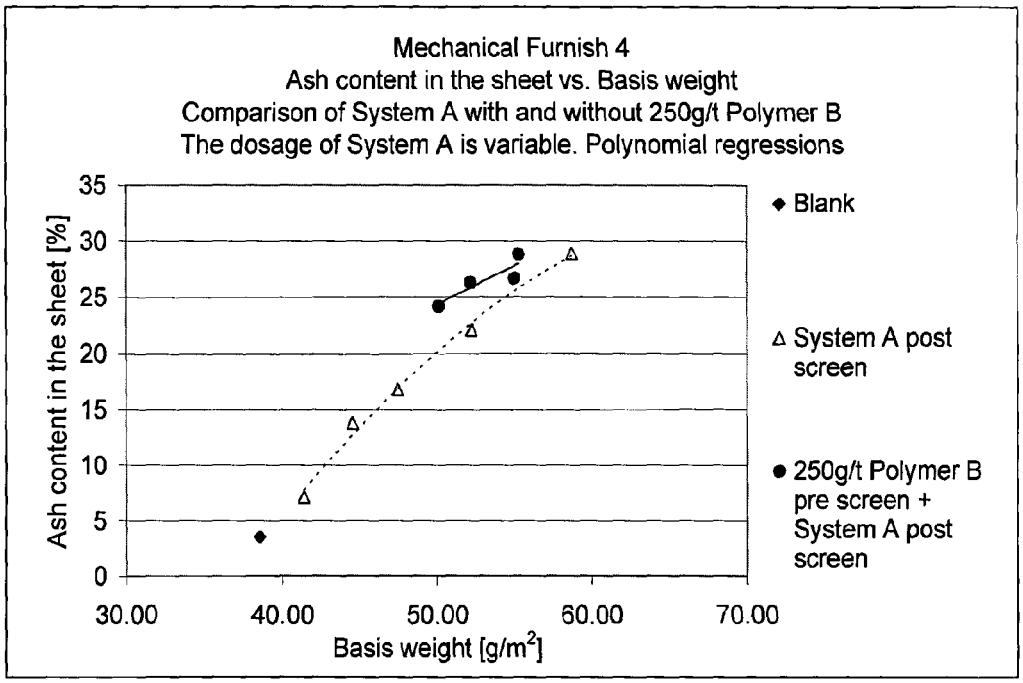
Figure 16: Mechanical furnish 4 with system B. Ash over basis weight
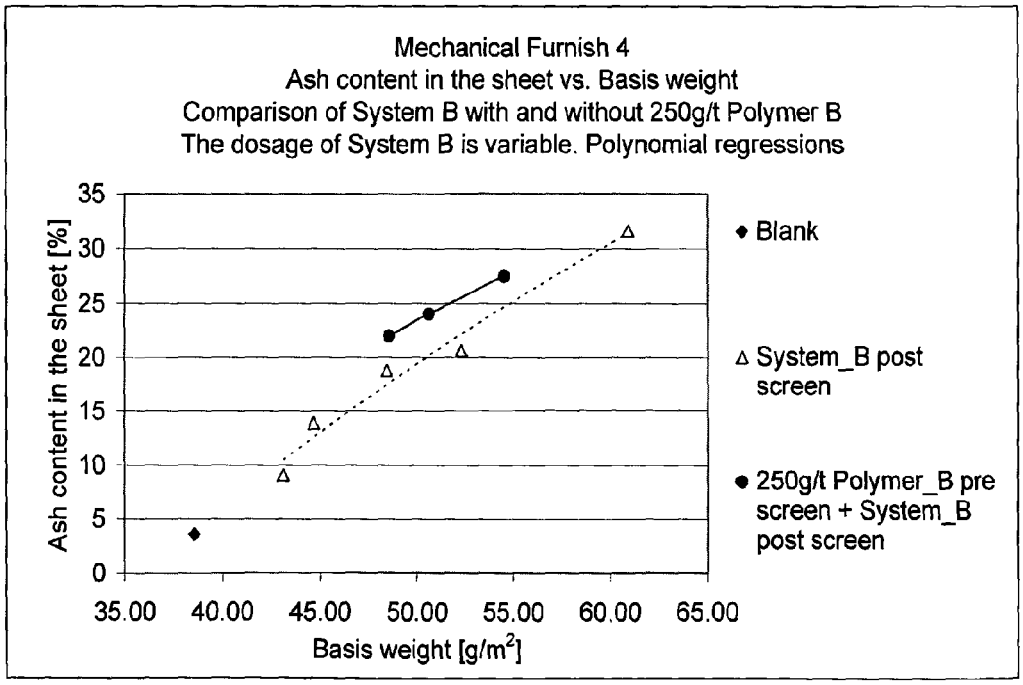

Figure 17: SC furnish 1 with system A. Ash over basis weight
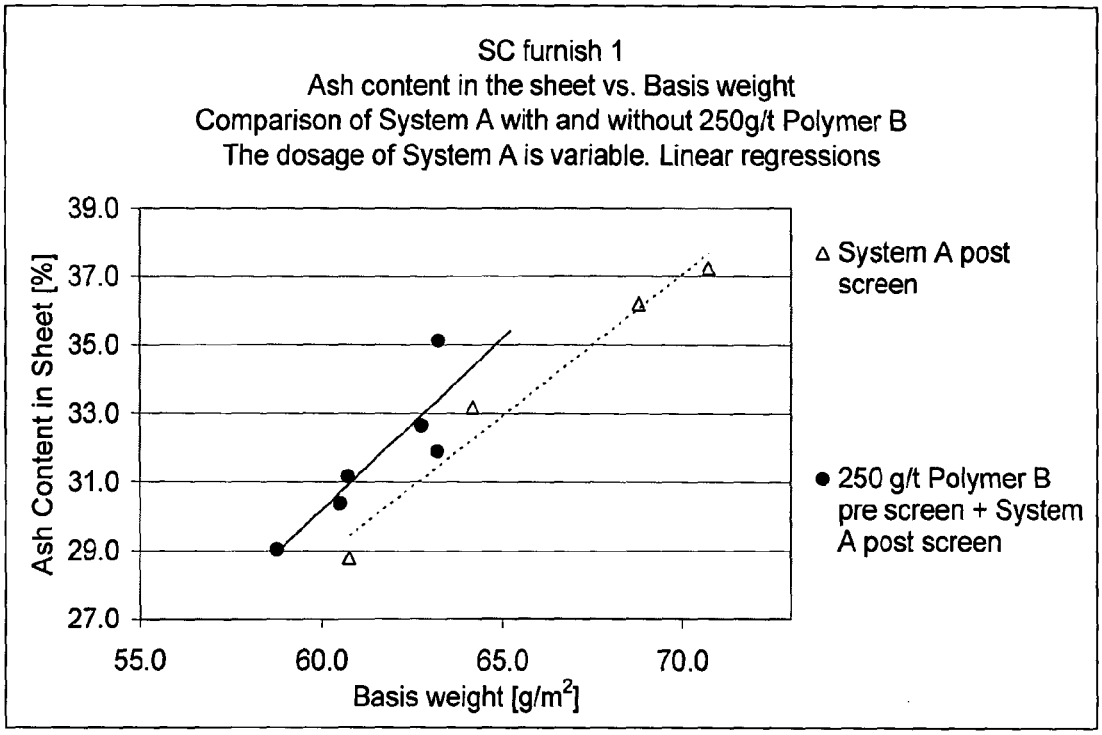
Figure 18: SC furnish 1 with system C and polymer B. Ash over basis weight
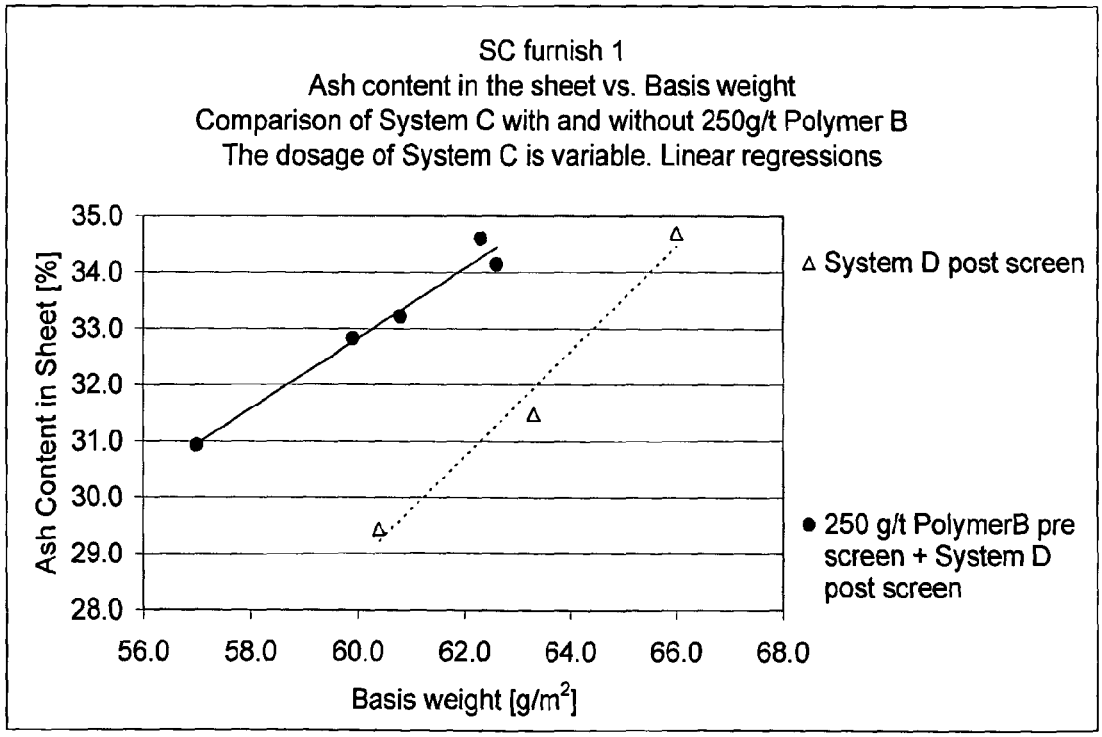

Figure 19: SC furnish 2 with system B. Ash over basis weight
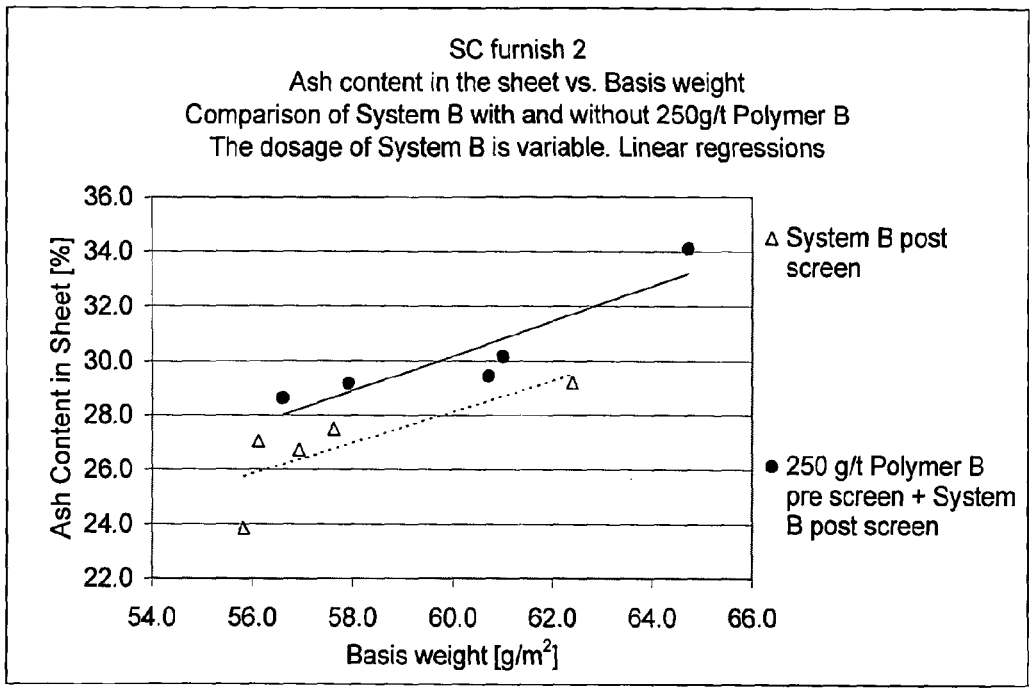
Figure 20: SC furnish 2 with system C and polymer C. TFR over basis weight
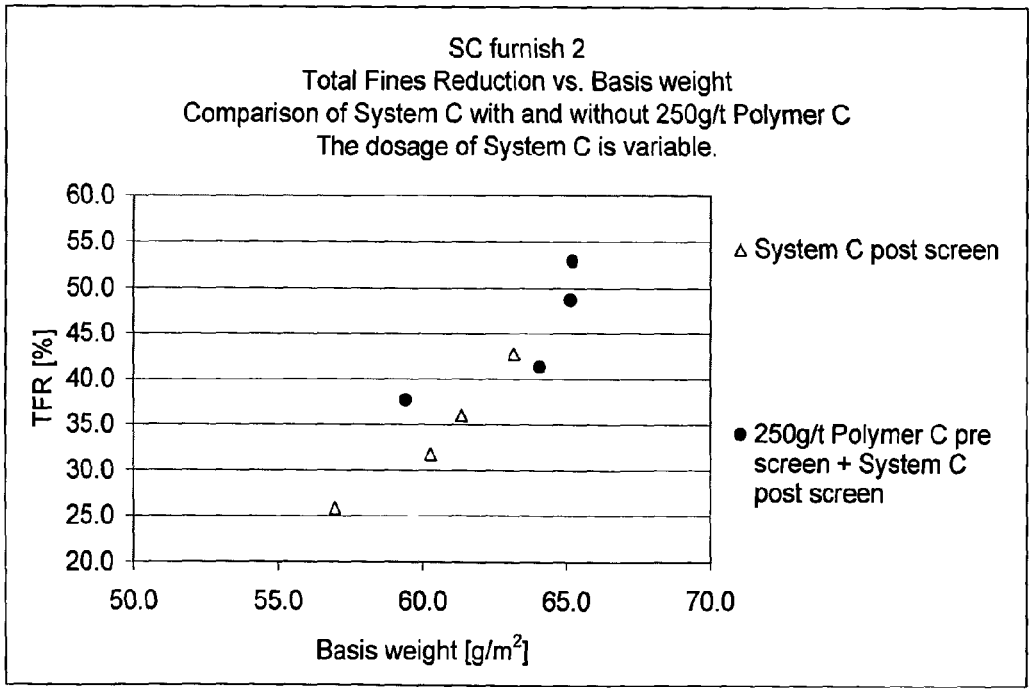

Figure 21: SC furnish 2 with system C and polymer C. Ash over basis weight
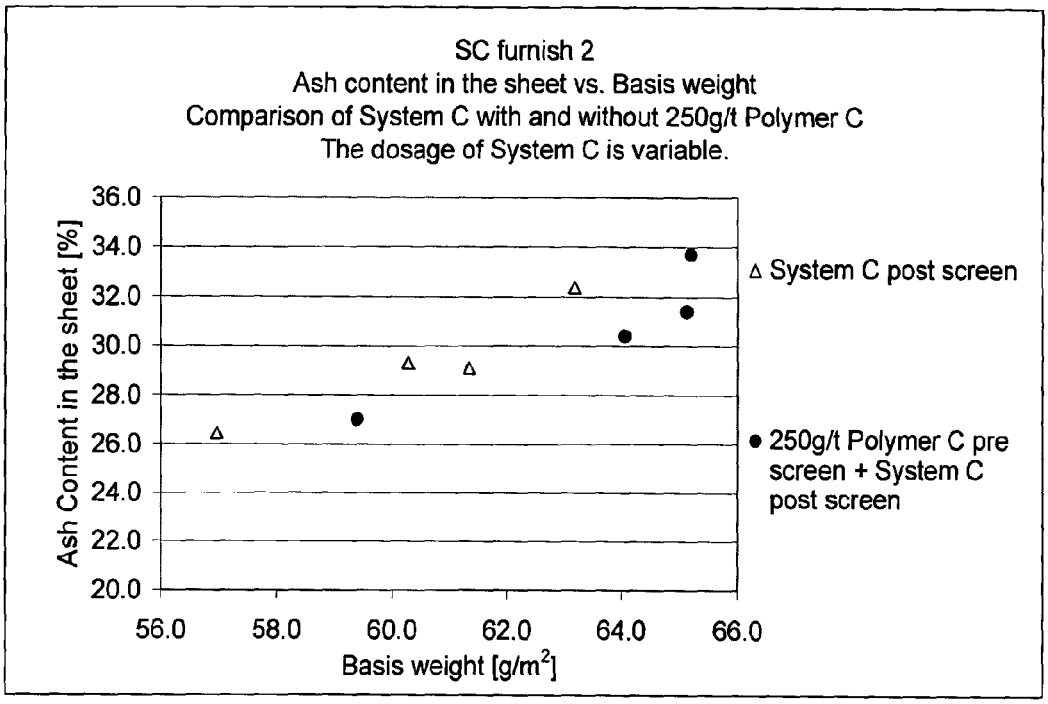

MANUFACTURE OF PAPER OR PAPERBOARD

This application is the National Stage of International Application No. PCT/EP2008/050680, filed Jan. 22, 2008, which claims priority to GB 0702249.4, filed Feb. 5, 2007.

The present invention concerns a process for the manufacture of filled paper or paperboard. Desirably the paper or paperboard is made from a furnish containing mechanical pulp and filler. In particular the invention includes processes for making highly filled mechanical paper grades, such as super calendared paper (SC-paper) or coated rotogravure (e.g. LWC). Furthermore, the invention is also suitable for the manufacture of paper or paperboard containing recycled pulp. The process provides improved ash retention relative to total retention.

It is well known to manufacture paper by a process that comprises flocculating a cellulosic thin stock by the addition of polymeric retention aid and then draining the flocculated suspension through a moving screen (often referred to as a machine wire) and then a forming a wet sheet, which is then dried. Some polymers tend to generate rather coarse flocs and although retention and drainage may be good unfortunately the formation and the rate of drying the resulting sheet can be impaired. It is often difficult to obtain the optimum balance between retention, drainage, drying and formation by adding a single polymeric retention aid and it is therefore common practise to add two separate materials in sequence or in some cases simultaneously.

Filled mechanical grade paper such as SC paper or coated rotogravure paper is often made using a soluble dual polymer retention system. This employs the use of two water-soluble polymers that are blended together as aqueous solutions before their addition to the thin stock. In general one of the polymers would have a higher molecular weight than the other. Both polymers would usually be linear and as water-soluble as reasonably possible. Usually the low molecular weight polymeric component would have a high cationic charge density, such as polyamine, polyethyleneimine or polyDADMAC (polymers of diallyl dimethyl ammonium chloride) coagulants. In contrast to the lower molecular weight polymers, the higher molecular weight polymeric component tends to have a relatively low cationic charge density. Typically such higher molecular weight polymers can be cationic polymers based on acrylamide or for instance polyvinyl amines. The blend of cationic polymers is commonly referred to as a cat/cat retention system.

In the general field of manufacturing paper and paperboard it is known to use other retention systems. Microparticulate retention systems employing siliceous material had been found to be very effective in improving retention and drainage. EP-A-235,893 describes a process in which a substantially linear cationic polymer is applied to the paper making stock prior to a shear stage in order to bring about flocculation, passing the flocculated stock through at least one shear stage and then reflocculating by introducing bentonite. In addition to wholly linear cationic polymers slightly cross-linked, for example branched polymers as described in EP-A-202780 may also be used. This process has been successfully commercialised by Ciba Specialty Chemicals under the trademark Hydrocol since it provides enhanced retention, drainage and formation.

Examples of other microparticulate systems used in papermaking industry are described in EP-A-0041056 and U.S. Pat. No. 4,385,961 for colloidal silica and in WO-A-9405596 and WO-A-9523021 with regard to silica based sols used in combination with cationic acrylamide polymers. U.S. Pat. No. 6,358,364, U.S. Pat. No. 6,361,652 and U.S. Pat. No. 6,361,653 each describe the use of borosilicates in conjunction with high molecular weight flocculants and/or starch in this sense.

EP 0041056 discloses a process of making paper from an aqueous papermaking stock and a binder comprising colloidal silicic acid and cationic starch, which is added to the stock for improving the retention of the stock components or is added to the white water for reducing the pollution problems or recovering values from the whitewater.

WO 00/17451 teaches a microparticle system for used as a retention and drainage aid for papermaking comprising a high molecular weight flocculant polymer, an acid colloid and a coagulant or a medium molecular weight flocculant. The acid colloid comprises an aqueous solution of a water-soluble polymer all to polymer of melamine aldehyde, preferably melamine formaldehyde.

In addition to inorganic insoluble microparticulate material water soluble anionic branched organic polymers are also known for papermaking processes.

WO-A-9829604 describes a process of making paper by addition of a cationic polymeric retention aid to a cellulosic suspension to form flocs, mechanically degrading the flocs and then re flocculating the suspension by adding a solution of a water-soluble anionic polymer as second polymeric retention aid. The anionic polymeric retention aid is a branched polymer having a rheological oscillation of tan delta at 0.005 Hz of above 0.7 and/or having a deionised SLV viscosity number at least three times the salted SLV viscosity number of the corresponding polymer made in the absence of branching agent. In this process the anionic branched polymer is always added subsequent to flocculating with a cationic retention aid and mechanical breakdown of the so formed flocs. The process provides significant improvements in retention, drainage and formation by comparison to the earlier prior art processes. It is emphasised on page 8 that the amount of branching agent should not be too high as the desired improvements in both dewatering and retention values will not be achieved. However there is nothing that would indicate improved ash retention relative to total retention.

U.S. Pat. No. 6,616,806 reveals a three component process of making paper by adding a substantially water-soluble polymer selected from a polysaccharide or a synthetic polymer of intrinsic viscosity at least 4 dl/g and then reflocculating by a subsequent addition of a reflocculating system. The reflocculating system comprises siliceous material and a substantially water-soluble polymer. The water-soluble polymer added before the reflocculating system is a water-soluble branched polymer that has an intrinsic viscosity above 4 dl/g and exhibits a rheological oscillation value of tan delta at 0.005 Hz of above 0.7. Drainage is increased without any significant impairment of formation in comparison to other known prior art processes.

U.S. Pat. No. 6,395,134 describes a process of making paper using a three component system in which cellulosic suspension is flocculated using a water-soluble cationic polymer, a siliceous material and an anionic branched water-soluble polymer formed from ethylenically unsaturated monomers having an intrinsic viscosity above 4 dl/g and exhibiting a rheological oscillation value of tan delta at 0.005 Hz of above 0.7. The process provides faster drainage and better formation than branched anionic polymer in the absence of colloidal silica. U.S. Pat. No. 6,391,156 describes an analogous process in which specifically bentonite is used as a siliceous material. This process also provides faster drainage and better formation than processes in which cationic polymer and branched anionic polymer are used in the absence of bentonite.

U.S. Pat. No. 6,451,902 discloses a process for making paper by applying a water-soluble synthetic cationic polymer to a cellulosic suspension specifically in the thin stock stream in order to flocculate it followed by mechanical degradation. After the centriscreen a water-soluble anionic polymer and a siliceous material are added in order to re flocculate the cellulosic suspension. Suitably the water-soluble anionic polymer can be a linear polymer. The process significantly increases drainage rate a comparison to cationic polymer and bentonite in the absence of the anionic polymer.

Producers of highly filled mechanical paper are facing increased environmental, economic and quality pressures, which mean that many paper mills tend to operate closed water systems, reduced basis weights, replacement of virgin fibre by recycled fibre as well as further increases in the filler content in the sheet. The desire to increase filler content is for the purpose of reducing the relative amount of expensive fibre required and also for improving whiteness, opacity and printability of paper so formed. In order to increase the ash level in the paper sheet the thin stock has to be adjusted towards higher ash loadings. It should be noted that higher ash loadings result in lower total retention in which event the thin stock consistency has to be increased to compensate for this effect. In turn, high thin stock consistencies combined with low retention often negatively impact sheet forming, system cleanliness, runnability and sheet properties such as dusting and strength.

Furthermore the increases in colloidal and fine particulate materials in the paper machine tend to negatively impact on the performance of flocculating systems necessary for retaining filler, fibre and other papermaking additives. It is believed that this difficulty arises because of the relatively high surface area of fines and colloidal material causing a greater consumption and reduced effectiveness of normal retention chemicals.

In addition such systems, especially closed systems where whitewater drained is recycled, the conductivity tends to increase due to the buildup of electrolyte. Increased conductivity also tends to exacerbate the difficulties in the effectiveness of the retention chemicals as a result of inefficient flocculation. In addition high conductivity impairs various other papermaking additives, such as size, and strength additives.

Highly concentrated colloidal dispersions tend to be destabilised under the high shear conditions that exist in the forming sections of modern paper machines and as a result can deposit to form deposits. A further disadvantage of the buildup of high levels of fine material is that this can lead to undesirable microbiological growth and slime buildup. Typical deposits result from colloidal and fine particulate pitch and sticky material, fibre fragments or biological material. This can also adversely affect the efficiency of the papermaking process, not least because of the potential for poor runability, imperfections and breaks the paper leading to an out of specification paper product which can only be remediated by closing the paper machine and cleaning. All of these disadvantages can adversely affect the economical viability of a paper machine.

Therefore it would be desirable to retain and/or remove as much of the fines and colloidal material in form of filler as is possible during the retention process. Furthermore, this should be achieved at the desired first pass retention level that is determined by the process and paper quality needs.

BRIEF SUMMARY

According to the present invention we provide a process of making paper or paperboard with improved ash retention relative to total retention comprising the steps of providing a thick stock cellulosic suspension that contains filler, diluting the thick stock suspension to form a thin stock suspension, in which the filler is present in the thin stock suspension in an amount of at least 10% by weight based on dry weight of thin stock suspension, flocculating the thick stock suspension and/or the thin stock using a polymeric retention/drainage system, draining the thin stock suspension on a screen to form a sheet and then drying the sheet, in which the polymeric retention/drainage system comprises, i) a water soluble branched anionic polymer and ii) a water soluble cationic or amphoteric polymer, wherein the anionic branched polymer is present in the thick stock or thin stock suspension prior to the addition of the cationic or amphoteric polymer.

The present process provides a means for incorporating preferentially more filler into the paper sheet. Thus ash retention, respectively the removal of fine and colloidal material is increased relative to total retention, the relative level of fibre retention will tend to reduced. This has the benefit of allowing paper sheets to contain a higher level of filler and a reduced level of fibre. This brings about significant commercial and quality advantages since fibre is often more expensive than the filler and whiteness, opacity and printability of the paper is improved. Furthermore machine runnability and paper quality due to system cleanliness and headbox consistency is not scarified. The present process is particularly useful for making filled mechanical grade papers such as rotogravure printing papers, for instance super calendared paper (SC-paper) and light weight coated (LWC) papers.

BRIEF DESCRIPTION OF THE DRAWINGS

FIG. 1: A plot of the number of fine and colloid particulates between 0.8 and 10 microns against the duration of the experiment. TFR=total fines reduction.

FIG. 2: A plot of the percentage of ash content in the sheet relative to the basis weight, comparing System A with and without Polymer B for fine paper furnish.

FIG. 3: A plot of the percentage of ash content in the sheet relative to the basis weight, comparing System B with and without Polymer B for fine paper furnish.

FIG. 4: A plot of the percentage of total fines reduction relative to basis weight, comparing System A with and without Polymer B for mechanical furnish 1. TFR=total fines reduction.

FIG. 5: A plot of the percentage of ash content in the sheet relative to basis weight, comparing System A with and without Polymer B for mechanical furnish 1.

FIG. 6: A plot of the percentage of total fines reduction relative to basis weight, comparing System A with and without 250 g/t Polymer B for mechanical furnish 2. TFR=total fines reduction.

FIG. 7: A plot of the percentage of total fines reduction relative to basis weight, comparing System B with and without 250 g/t Polymer B for mechanical furnish 2. TFR=total fines reduction.

FIG. 8: A plot of the percentage of ash content in the sheet relative to basis weight, comparing System A with and without 250 g/t Polymer B for mechanical furnish 2.

FIG. 9: A plot of the percentage of ash content in the sheet relative to basis weight, comparing System B with and without 250 g/t Polymer B for mechanical furnish 2.

FIG. 10: A plot of the percentage of ash content in the sheet relative to basis weight, comparing System A with and without 250 g/t Polymer B for mechanical furnish 3.

FIG. 11: A plot of the percentage of total fines reduction relative to basis weight, comparing System C and E with and without Polymer B for mechanical furnish 3. TFR=total fines reduction.

FIG. 12: A plot of the percentage of ash content in the sheet relative to basis weight, comparing Systems C and E with and without 250 g/t Polymer B for mechanical furnish 3.

FIG. 13: A plot of the percentage of total fines reduction relative to basis weight, comparing System A with and without 250 g/t Polymer B for mechanical furnish 4. TFR=total fines reduction.

FIG. 14: A plot of the percentage of total fines reduction relative to basis weight, comparing System B with and without 250 g/t Polymer B for mechanical furnish 4. TFR=total fines reduction.

FIG. 15: A plot of the percentage of ash content in the sheet relative to basis weight, comparing System A with and without 250 g/t Polymer B for mechanical furnish 4.

FIG. 16: A plot of the percentage of ash content in the sheet relative to basis weight, comparing System B with and without 250 g/t Polymer B for mechanical furnish 4.

FIG. 17: A plot of the percentage of ash content in the sheet relative to basis weight, comparing System A with and without 250 g/t Polymer B for SC furnish 1.

FIG. 18: A plot of the percentage of ash content in the sheet relative to basis weight, comparing System C with and without 250 g/t Polymer B for SC furnish 1.

FIG. 19: A plot of the percentage of ash content in the sheet relative to basis weight, comparing System B with and without 250 g/t Polymer B for SC furnish 2.

FIG. 20: A plot of the percentage of total fines reduction relative to basis weight, comparing System C with and without 250 g/t Polymer C for SC furnish 2. TFR=total fines reduction.

FIG. 21: A plot of the percentage of ash content in the sheet relative to basis weight, comparing System C with and without 250 g/t Polymer C for SC furnish 2.

DETAILED DESCRIPTION

A description of fines and colloidal material can be found in Tappi Method T 261 pm-80 "Fines Fraction of Paper Stock by Wet Screening". In this Tappi method, the term "fines" is described as the portion of papermaking stock sample that will pass through a 200 mesh screen (or its nominal equivalent of hole diameter size of 76 microns) as used for standard retention testing with the "Britt Jar" device.

In the present invention we define the removal of the 0.8 to 10 micron range of chord lengths during the retention process derived from Scanning Laser Microscopy, often referred to as FBRM. We find good correlation between ash retention and removal of this fraction.

Preferably the water-soluble cationic or amphoteric polymer is a natural polymer or a synthetic polymer that has an intrinsic viscosity of at least 1.5 dl/g. Suitable natural polymers include polysaccharides that carry a cationic charge usually by post modification or alternatively are amphoteric by virtue that they carry both cationic and anionic charges. Typical natural polymers include cationic starch, amphoteric starch, chitin, chitosan etc. Preferably the cationic or amphoteric polymer is synthetic. More preferably the synthetic polymer is formed from ethylenically unsaturated cationic monomer or blend of monomers including at least one cationic monomer and if amphoteric at least one cationic monomer and at least one anionic monomer. When the polymer is amphoteric it is preferred that it carries more cationic groups than anionic groups such that the amphoteric polymer is predominantly cationic. In general cationic polymers are preferred. Particularly preferred cationic or amphoteric polymers have an intrinsic viscosity of at least 3 dl/g. Typically the intrinsic viscosity will be at least 4 dl/g, and often it can be as high as 20 or 30 dl/g but preferably will be between 4 and 10 dl/g.

Intrinsic viscosity of polymers may be determined by preparing an aqueous solution of the polymer (0.5-1% w/w) based on the active content of the polymer. 2 g of this 0.5-1% polymer solution is diluted to 100 ml in a volumetric flask with 50 ml of 2M sodium chloride solution that is buffered to pH 7.0 (using 1.56 g sodium dihydrogen phosphate and 32.26 g disodium hydrogen phosphate per liter of deionised water) and the whole is diluted to the 100 ml mark with deionised water. The intrinsic viscosity of the polymers is measured using a Number 1 suspended level viscometer at 25° C. in 1M buffered salt solution. Intrinsic viscosity values stated are determined according to this method unless otherwise stated.

The polymer may be prepared by polymerisation of a water soluble monomer or water soluble monomer blend. By water soluble we mean that the water soluble monomer or water soluble monomer blend has a solubility in water of at least 5 g in 100 ml of water and 25° C. The polymer may be prepared conveniently by any suitable polymerisation process.

Preferably the water soluble polymer is cationic and is formed from one or more ethylenically unsaturated cationic monomers optionally with one or more of the nonionic monomers referred to herein. The cationic monomers include dialkylamino alkyl(meth)acrylates, dialkylamino alkyl (meth) acrylamides, including acid addition and quaternary ammonium salts thereof, diallyl dimethyl ammonium chloride. Preferred cationic monomers include the methyl chloride quaternary ammonium salts of dimethylamino ethyl acrylate and dimethyl aminoethyl methacrylate. Suitable non-ionic monomers include unsaturated nonionic monomers, for instance acrylamide, methacrylamide, hydroxyethyl acrylate, N-vinylpyrrolidone. A particularly preferred polymer includes the copolymer of acrylamide with the methyl chloride quaternary ammonium salts of dimethylamino ethyl acrylate.

When the polymer is amphoteric it may prepared from at least one cationic monomer and at least one anionic monomer and optionally at least one non-ionic monomer. The cationic monomers and optionally non-ionic monomers are stated above in regard to cationic polymers. Suitable anionic monomers include acrylic acid, methacrylic acid, maleic acid, crotonic acid, itaconic acid, vinylsulphonic acid, allyl sulphonic acid, 2-acrylamido-2-methylpropane sulphonic acid and salts thereof.

The polymers may be linear in that they have been prepared substantially in the absence of branching or cross-linking agent. Alternatively the polymers can be branched or cross-linked, for example as in EP-A-202780.

Desirably the polymer may be prepared by reverse phase emulsion polymerisation, optionally followed by dehydration under reduced pressure and temperature and often referred to as azeotropic dehydration to form a dispersion of polymer particles in oil. Alternatively the polymer may be provided in the form of beads by reverse phase suspension polymerisation, or as a powder by aqueous solution polymerisation followed by comminution, drying and then grinding. The polymers may be produced as beads by suspension polymerisation or as a water-in-oil emulsion or dispersion by water-in-oil emulsion polymerisation, for example according to a process defined by EP-A-150933, EP-A-102760 or EP-A-126528.

It is particularly preferred that the polymer is cationic and is formed from at least 10% by weight cationic monomer or monomers. Even more preferred are polymers comprising at least 20 or 30% by weight cationic monomer units. It may be desirable to employ cationic polymers having very high cationicities, for instance greater than 50% up to 80 or even 100% cationic monomer units. It is especially preferred when the cationic second flocculant polymer is selected from the group consisting of cationic polyacrylamides, polymers of dialkyl diallyl ammonium chloride for example diallyl dimethyl ammonium chloride, dialkyl amino alkyl(meth)-acrylates (or salts thereof) and dialkyl amino alkyl(meth)-acrylamides (or salts thereof). Other suitable polymers include polyvinyl amines and Manich modified polyacrylamides. Particularly preferred polymers include between 20 and 60% by weight dimethyl amino ethyl acrylate and/or methacrylate and between 40 and 80% by weight acrylamide.

The dose of water-soluble cationic or amphoteric polymer should be an effective amount and will normally be at least 20 g and usually at least 50 g per tonne of dry cellulosic suspension. The dose can be as high as one or two kilograms per tonne but will usually be within the range of 100 or 150 g per tonne up to 800 g per tonne. Usually more effective results are achieved when the dose of water-soluble cationic or amphoteric polymer is at least 200 g per tonne, typically at least 250 g per tonne and frequently at least 300 g per tonne.

The cationic or amphoteric polymer may be added into the thick stock or into the thin stock stream. Preferably the cationic or amphoteric polymer is added into the thin stock stream, for instance prior to one or the mechanical degradation stages, such as fan pump or centriscreen. Preferably the polymer is added after at least one of the mechanical degradation stages.

Particularly effective results are found when the water-soluble cationic or amphoteric polymer is used in conjunction with a cationic coagulant. The cationic coagulant may be an inorganic material such as alum, polyaluminium chloride, aluminium chloride trihydrate and aluminochloro hydrate. However, it is preferred that the cationic coagulant is an organic polymer.

The cationic coagulant is desirably a water soluble polymer which may for instance be a relatively low molecular weight polymer of relatively high cationicity. For instance the polymer may be a homopolymer of any suitable ethylenically unsaturated cationic monomer polymerised to provide a polymer with an intrinsic viscosity of up to 3 dl/g. Typically the intrinsic viscosity will usually the at least 0.1 dl/g and frequently within the range of 0.2 or 0.5 dl/g to 1 or 2 dl/g. Homopolymers of diallyl dimethyl ammonium chloride (DADMAC) are preferred. Other cationic coagulants of value include polyethylene imine, polyamine epichlorohydrin and polydicyandiamide.

The low molecular weight high cationicity polymer may for instance be an addition polymer formed by condensation of amines with other suitable di- or tri-functional species. For instance the polymer may be formed by reacting one or more amines selected from dimethyl amine, trimethyl amine and ethylene diamine etc and epihalohydrin, epichlorohydrin being preferred. Other suitable cationic coagulant polymers include low molecular weight high charge density polyvinyl amines. Polyvinyl amines can be prepared by polymerisation vinyl acetamide to form polyvinyl acetamide followed by hydrolysis the resulting in polyvinyl amines. In general the cationic coagulants exhibit a cationic charge density of at least 2 and usually at least 3 mEq/g and may be as high as 4 or 5 mEq/g or higher.

It is particularly preferred that the cationic coagulant is a synthetic polymer of intrinsic viscosity at least 1 or 2 dl/g often up to 3 dl/g or even higher and exhibiting a cationic charge density of greater than 3 meq/g, preferably a homopolymer of DADMAC. PolyDADMACs can be prepared by polymerising an aqueous solution of DADMAC monomer using redox initiators to provide an aqueous solution of polymer. Alternatively an aqueous solution of DADMAC monomer can be suspended in a water immiscible liquid using suspending agents e.g. surfactants or stabilisers and polymerised to form polymeric beads of polyDADMAC.

An especially preferred cationic coagulant is a relatively high molecular weight homopolymer of DADMAC that exhibits an intrinsic viscosity of at least 2 dl/g. Such a polymer can be made by preparing an aqueous solution containing DADMAC monomer, a radical initiator or mixture are radical initiators in a or between 0.1 and 5% based on the monomer and optionally a chelating agent. Heating this monomer mixture at the temperature and below 60° C. in order to polymerise the monomer to the homopolymer having a level of conversion between 80 and 99%. Then post treating this homopolymer by heating a two-way temperature between 60 and 120° C. Typically this polymer of DADMAC can be prepared in accordance with the description given in PCT/EP 2006/067244.

An effective amount dose of cationic coagulant will typically be at least 20 g and usually at least 50 g per tonne of dry cellulosic suspension. The dose can be as high as one or two kilograms per tonne but will usually be within the range of 100 or 150 g per tonne up to 800 g per tonne. Usually more effective results are achieved when the dose of water-soluble cationic or amphoteric polymer is at least 200 g per tonne, typically at least 250 g per tonne and frequently at least 300 g per tonne.

The water-soluble cationic or amphoteric polymer and the cationic coagulant may be added sequentially or simultaneously. The cationic coagulant may be added into the thick stock or into the thin stock. In some circumstances it may be useful to add the cationic coagulant into the mixing chest or blend chest or alternatively into one or more components of the thick stock. The cationic coagulant may be added prior to the water-soluble cationic or amphoteric polymer or alternatively it may be added subsequent to the water-soluble cationic or amphoteric polymer. Preferably, however, the water-soluble cationic or amphoteric polymer and cationic coagulant are added to the cellulosic suspension as a blend. This blend may be referred to as a cat/cat retention system.

Generally the water-soluble cationic or amphoteric polymer will have a higher molecular weight (and intrinsic viscosity) than the cationic coagulant.

The amount of cat/cat blend will normally be as stated above in relation to each of the two components. In general we find that the dosage of cationic or amphoteric polymer alone or the cat/cat blend is lower in comparison to a system in which branched anionic polymer is not included.

The water-soluble branched anionic polymer may be any suitable water-soluble polymer that has at least some degree of branching or structuring, provided that the structuring is not so excessive as to render the polymer insoluble.

Preferably the water-soluble branched anionic polymer has (a) intrinsic viscosity above 1.5 dl/g and/or saline Brookfield viscosity (UL viscosity) of above about 2.0 mPa·s and (b) rheological oscillation value of tan delta at 0.005 Hz of above 0.7 and/or (c) deionised SLV viscosity number which is at least three times the salted SLV viscosity number of the corresponding unbranched polymer made in the absence of branching agent.

The anionic branched polymer is formed from a water soluble monomer blend comprising at least one anionic or potentially anionic ethylenically unsaturated monomer and a small amount of branching agent for instance as described in WO-A-9829604. Generally the polymer will be formed from a blend of 5 to 100% by weight anionic water soluble monomer and 0 to 95% by weight non-ionic water soluble monomer.

Typically the water soluble monomers have a solubility in water of at least 5 g/100 $cm^3$. The anionic monomer is preferably selected from the group consisting of acrylic acid, methacrylic acid, maleic acid, crotonic acid, itaconic acid, 2-acrylamido-2-methylpropane sulphonic acid, allyl sulphonic acid and vinyl sulphonic acid and alkali metal or ammonium salts thereof. The non-ionic monomer is preferably selected from the group consisting of acrylamide, methacrylamide, N-vinyl pyrrolidone and hydroxyethyl acrylate. A particularly preferred branched polymer comprises sodium acrylate with branching agent or acrylamide, sodium acrylate and branching agent.

The branching agent can be any chemical material that causes branching by reaction through the carboxylic or other pendant groups (for instance an epoxide, silane, polyvalent metal or formaldehyde). Preferably the branching agent is a polyethylenically unsaturated monomer which is included in the monomer blend from which the polymer is formed. The amounts of branching agent required will vary according to the specific branching agent. Thus when using polyethylenically unsaturated acrylic branching agents such as methylene bis acrylamide the molar amount is usually below 30 molar ppm and preferably below 20 ppm. Generally it is below 10 ppm and most preferably below 5 ppm. The optimum amount of branching agent is preferably from around 0.5 to 3 or 3.5 molar ppm or even 3.8 ppm but in some instances it may be desired to use 7 or 10 ppm.

Preferably the branching agent is water-soluble. Typically it can be a difunctional material such as methylene bis acrylamide or it can be a trifunctional, tetrafunctional or a higher functional cross-linking agent, for instance tetra allyl ammonium chloride. Generally since allylic monomer tend to have lower reactivity ratios, they polymerise less readily and thus it is standard practice when using polyethylenically unsaturated allylic branching agents, such as tetra allyl ammonium chloride to use higher levels, for instance 5 to 30 or even 35 molar ppm or even 38 ppm and even as much as 70 or 100 ppm.

It may also be desirable to include a chain transfer agent into the monomer mix. Where chain transfer agent is included it may be used in an amount of at least 2 ppm by weight and may also be included in an amount of up to 200 ppm by weight. Typically the amounts of chain transfer agent may be in the range 10 to 50 ppm by weight. The chain transfer agent may be any suitable chemical substance, for instance sodium hypophosphite, 2-mercaptoethanol, malic acid or thioglycolic acid. Preferably, however, the anionic branched polymer is prepared in the absence of added chain transfer agent.

The anionic branched polymer is generally in the form of a water-in-oil emulsion or dispersion. Typically the polymers are made by reverse phase emulsion polymerisation in order to form a reverse phase emulsion. This product usually has a particle size at least 95% by weight below 10 μm and preferably at least 90% by weight below 2 μm, for instance substantially above 100 nm and especially substantially in the range 500 nm to 1 μm. The polymers may be prepared by conventional reverse phase emulsion or microemulsion polymerisation techniques.

The tan delta at 0.005 Hz value is obtained using a Controlled Stress Rheometer in Oscillation mode on a 1.5% by weight aqueous solution of polymer in deionised water after tumbling for two hours. In the course of this work a Carrimed CSR 100 is used fitted with a 6 cm acrylic cone, with a 1°58' cone angle and a 58 μm truncation value (Item ref 5664). A sample volume of approximately 2-3 cc is used. Temperature is controlled at 20.0° C.±0.1° C. using the Peltier Plate. An angular displacement of $5\times10^{-4}$ radians is employed over a frequency sweep from 0.005 Hz to 1 Hz in 12 stages on a logarithmic basis. G' and G" measurements are recorded and used to calculate tan delta (G"/G') values. The value of tan delta is the ratio of the loss (viscous) modulus G" to storage (elastic) modulus G' within the system.

At low frequencies (0.005 Hz) it is believed that the rate of deformation of the sample is sufficiently slow to enable linear or branched entangled chains to disentangle. Network or cross-linked systems have permanent entanglement of the chains and show low values of tan delta across a wide range of frequencies, Therefore low frequency (e.g. 0.005 Hz) measurements are used to characterise the polymer properties in the aqueous environment.

The anionic branched polymers should have a tan delta value at 0.005 Hz of above 0.7. Preferred anionic branched polymers have a tan delta value of 0.8 at 0.005 Hz. The tan delta value can be at least 1.0 and in some cases can be as high as 1.8 or 2.0 or higher. Preferably the intrinsic viscosity is at least 2 dl/g, for instance at least 4 dl/g, in particular at least 5 or 6 dl/g. It may be desirable to provide polymers of substantially higher molecular weight, which exhibit intrinsic viscosities as high as 16 or 18 dl/g. However most preferred polymers have intrinsic viscosities in the range 7 to 12 dl/g, especially 8 to 10 dl/g.

The preferred branched anionic polymer can also be characterised by reference to the corresponding polymer made under the same polymerisation conditions but in the absence of branching agent (i.e., the "unbranched polymer"). The unbranched polymer generally has an intrinsic viscosity of at least 6 dl/g and preferably at least 8 dl/g. Often it is 16 to 30 dl/g. The amount of branching agent is usually such that the intrinsic viscosity is reduced by 10 to 70%, or sometimes up to 90%, of the original value (expressed in dl/g) for the unbranched polymer referred to above.

The saline Brookfield viscosity (UL viscosity) of the polymer is measured by preparing a 0.1% by weight aqueous solution of active polymer in 1M NaCl aqueous solution at 25° C. using a Brookfield viscometer fitted with a UL adaptor at 6 rpm. Thus, powdered polymer or a reverse phase polymer would be first dissolved in deionised water to form a concentrated solution and this concentrated solution is diluted with the 1M NaCl aqueous. The saline solution viscosity is usually above 2.0 mPa·s and is often at least 2.2 and preferably at least 2.5 mPa·s. In many cases it is not more than 5 mPa·s and values of 3 to 4 are usually preferred. These are all measured at 60 rpm.

The SLV viscosity numbers used to characterise the anionic branched polymer are determined by use of a glass suspended level viscometer at 25° C., the viscometer being chosen to be appropriate according to the viscosity of the solution. The viscosity number is $\eta-\eta_o/\eta_o$ where $\eta$ and $\eta_o$ are the viscosity results for aqueous polymer solutions and solvent blank respectively. This can also be referred to as specific viscosity. The deionised SLV viscosity number is the number obtained for a 0.05% aqueous solution of the polymer prepared in deionised water. The salted SLV viscosity number is the number obtained for a 0.05% polymer aqueous solution prepared in 1M sodium chloride.

The deionised SLV viscosity number is preferably at least 3 and generally at least 4, for instance up to 7, 8 or higher. Best results are obtained when it is above 5. Preferably it is higher than the deionised SLV viscosity number for the unbranched polymer, that is to say the polymer made under the same polymerisation conditions but in the absence of the branching agent (and therefore having higher intrinsic viscosity). If the deionised SLV viscosity number is not higher than the deionised SLV viscosity number of the unbranched polymer, preferably it is at least 50% and usually at least 75% of the deionised SLV viscosity number of the unbranched polymer. The salted SLV viscosity number is usually below 1. The deionised SLV viscosity number is often at least five times, and preferably at least eight times, the salted SLV viscosity number.

The water-soluble anionic branched polymer may suitably be added to the cellulosic suspension at a dose of at least 10 g per tonne based on the dry weight. The amount may be as much as 2000 or 3000 g per tonne or higher. Preferably the dose will be between 100 g per tonne and 1000 g per tonne, more preferably between 150 g per tonne and 750 g per tonne. More preferably still the dose will often be between 200 and 500 grams per tonne. All doses are based on weight of active polymer on the dry weight of cellulosic suspension.

The water-soluble anionic branched polymer may suitably be added at any convenient point in the process, for instance into the thin stock suspension or alternatively into the thick stock suspension. In some cases it may be desirable to add the anionic polymer into the mixing chest, blend chest or perhaps into one or more are the stock components. Preferably however, the anionic polymer is added into the thin stock. The exact point on the addition may be before one of the shear stages. Typically such shear stages include mixing, pumping and cleaning stages or other stages that induced mechanical degradation of flocs. Desirably the shear stages are selected from one of the fan pumps or centriscreens. Alternatively this anionic polymer may added after one or more of the fan pumps but before the centriscreen or in some cases after the centriscreen.

The shear stages may be regarded as mechanical shearing steps and desirably act upon the flocculated suspension in such a way as to degrade the flocs. All the components of the retention/drainage system may be added prior to a shear stage although preferably at least the water-soluble cationic or amphoteric polymer or the cat/cat system as last component(s) of the retention/drainage system is/are added to the cellulosic suspension at a point in the process where there is no substantial shearing before draining to form the sheet. Thus it is preferred that the water-soluble anionic branched polymer is added to the cellulosic suspension and the flocculated suspension so formed is then subjected to mechanical shear wherein the flocs are mechanically degraded and then the cationic or amphoteric polymer or the so called cat/cat retention system is added to reflocculate the suspension prior to draining.

The anionic branched polymer may suitably be added to the cellulosic suspension and then the flocculated suspension so formed may be passed through one or more shear stages. The cationic or amphoteric polymer may be added to reflocculate the suspension, which reflocculated suspension may then be subjected to further mechanical shearing. The sheared reflocculated suspension may also be further flocculated by addition of a third component. Such a three component retention/drainage system is for instance where the cationic coagulant is used in addition to the water-soluble cationic or amphoteric polymer and anionic branched polymer. Alternatively the cationic coagulant may be added to reflocculate the sheared suspension which may be subjected to further mechanical shearing followed by a further flocculation step by addition of a cationic or amphoteric polymer.

We have, however, found that particularly effective results in terms of improved ash retention relative to total retention is achieved in a process where the anionic water-soluble branched polymer is added to the thin stock suspension followed by addition of at least the cationic or amphoteric polymer and preferably also the water-soluble cationic coagulant, herein referred to as cat/cat retention system.

Consequently the water-soluble branched anionic polymer is desirably already present in the cellulosic suspension before addition of the cationic or amphoteric polymer and where employed the water-soluble cationic coagulant. This order of addition is unusual since been many known processes it is normal convention to add the cationic retention aid and especially any cationic coagulant prior to any anionic polymeric retention aid.

When the water-soluble branched anionic polymer is added to the cellulosic suspension it will normally bring about flocculation of the suspended solids. Preferably the cellulosic suspension is subjected to at least one stage that brings about mechanical degradation prior to the addition of the cationic or amphoteric polymer or the so called cat/cat system. Generally the cellulosic suspension may be passed through one or more of these stages. Typically such stages are shear stages that include mixing, pumping and cleaning stages, such as one of the fan pumps or centriscreens. In a more preferred aspect of the process the water-soluble branched polymer is added prior to a centriscreen and the cationic or amphoteric polymer and where employed the cat/cat system is added to the cellulosic suspension after the centriscreen.

The paper or paperboard can contain any type of short or long fibre chemical pulp, for instance pulps made with the sulphite or sulphate (Kraft) process. In contrast to mechanical pulps the lignin is widely removed from chemical pulps.

Preferably, the paper or paperboard will contain at least 10% mechanical fibre based on the dry weight of the suspension. Typically in filled paper grades the filler represents the majority of fine particles, a relative increased fine particle reduction as defined by Scanning Laser Microscopy in the paper stock compared to the total retention indicates the potential for higher ash retention relative to total retention.

Without being limited theory we believe that when making paper from highly filled (i.e. at least 10% by weight filler) paper furnish containing mechanical fibre the initial treatment by anionic branched polymer followed by treatment with the cationic or amphoteric polymer or cat/cat system somehow brings about an interaction causing a greater retention of fine and colloidal sized filler particles.

The filled paper may be any suitable paper made from a cellulosic suspension containing mechanical fibre and at least 10% by weight filler based on the dry weight of thin stock. For instance the paper may be a lightweight coated paper (LWC) or more preferably it is a super calendared paper (SC-paper).

By mechanical fibre we mean that the cellulosic suspension comprises mechanical pulp, indicating any wood pulp manufactured wholly or in part by a mechanical process, including stone ground wood (SGW), thermomechanical pulp (TMP), chemithermomechanical pulp (CTMP), bleached chemithermomechanical pulp (BCTMP) or pressurised ground wood (PGW). Mechanical paper grades contain different amounts of mechanical pulp and this is usually included in order to provide the desired optical and mechanical properties. In some cases the pulp used in making the filled paper may be formed of entirely of one or more of the aforementioned mechanical pulps. In addition to mechanical pulps other pulps are often included in the cellulosic suspension. Typically the other pulps may form at least 10% by weight of the total fibre content. These other pulps the included in the paper recipe include deinked pulp and sulphate pulp (often referred to as kraft pulp).

A preferred composition for SC paper is characterised in that the fibre faction contains deinked pulp, mechanical pulp and sulphate pulp. The mechanical pulp content may vary between 10 and 75%, preferably between 30 and 60% by weight of the total fibre content. The deinked pulp content (often referred to as DIP) may any between 0 and 90%, typically between 20 and 60% by weight of total fibre. The sulphate pulp content usually varies between 0 and 50%, preferably between 10 and 25% by weight of total fibre. The components when totaled should be 100%.

The cellulosic suspension may contain other ingredients such as cationic starch and/or additional coagulants. Typically this cationic starch and/or coagulants may be present in the paper stock in for the addition of the retention/drainage system of the present invention. The cationic starch may be present in an amount between 0 and 5%, typically between 0.2 and 1% by weight of cellulosic fiber. The coagulant will usually be added in amounts of up to 1% by weight of the cellulosic fiber, typically between 0.2 and 0.5%.

Desirably the filler may be a traditionally used filler material. For instance the filler may be a clay such as kaolin, or the may be a calcium carbonate which may be ground calcium carbonate or preferably precipitated calcium carbonate (PCC). Another preferred filler material includes titanium dioxide. Examples of other filler materials also include synthetic polymeric fillers.

In general the cellulosic stock used in the present invention will preferably comprise significant quantities of filler, usually greater than 10% based on dry weight of the cellulosic stock. However, usually a cellulosic stock that contains substantial quantities of filler is more difficult to flocculate than cellulosic stocks used the may have paper grades that contain no or less filler. This is particularly true of fillers of very fine particle size, such as precipitated calcium carbonate, introduced to the paper stock as a separate additive or as sometimes is the case added with deinked pulp or other recycled fibre.

The present invention enables highly filled paper to be made from cellulosic stock containing high levels of filler and also containing mechanical fibre, such as SC paper or coated rotogravure paper, for instance LWC with excellent retention and formation and maintained or reduced drainage which allows for better retention of fines and colloidal material in the sheet that is formed on the machine wire. Typically the paper making stock will need to contain significant levels of filler in the thin stock, usually at least 25% or at least 30% by weight of dry suspension. Frequently the amount of filler in the headbox furnish before draining the suspension to form a sheet is up to 70% by weight of dry suspension, preferably between 50 and 65% of filler. Desirably the final sheet of paper will comprise up to 40% filler by weight. It should be noted that typical SC paper grades contain between 25 and 35% filler in the sheet.

Preferably the process is operated using an extremely fast draining paper machine, especially those paper machines that have extremely fast draining twin wire forming sections, in particular those machines referred to as Gapformers or Hybridformers. The invention is particularly suitable for the production of highly filled mechanical grade papers, such as SC paper on paper machines where the loss of filler material would otherwise result. The process enables retention and formation to be balanced in an optimised fashion a significantly improved retention of filler typically on paper machines known as Gapformers and Hybridformers.

In the process of the present invention we find that in general the first pass total and ash retention may be adjusted to any suitable level depending upon the process and production needs. SC paper grades are usually produced at lower total and ash retention levels than other paper grades, such as fine paper, highly filled copy paper, paperboard or newsprint. Generally first pass total retention levels range from 30 to 60% by weight, typically from between 35 and 50%. Usually ash retention level may be in the range of from 15 to 45% by weight, typically between 20 and 35%.

When making paper containing mechanical fibre component, especially SC grade paper a particularly preferred system according to the invention would employ a polyDADMAC as the cationic coagulant especially where the cationic coagulant is used in a cat/cat system in which the polyDADMAC is used in conjunction with a high molecular weight cationic or amphoteric polymer, especially a cationic polymer. We find particular improvements in ash retention relative to total retention.

One preferred aspect involves making paper or paperboard containing recycled fiber, for instance DIP (deinked pulp). Typically this paper may be for instance newsprint or packaging paper or paperboard. We have found that significant improvements in ash retention relative to total retention are obtained in the preferred process according to the present invention using any cationic coagulant, especially in cat/cat systems in which the cationic coagulant is used in conjunction with amphoteric or especially cationic polymer.

The following examples illustrate the invention.

EXAMPLES

Methods

1. Preparation of Polymers

All polymers and coagulants are prepared as 0.1% aqueous solutions based on actives. The premixes consist of 50% high molecular weight polymer and 50% coagulant and are blended together as 0.1% aqueous solutions before their addition to the furnish.

Starch was prepared as 1% aqueous solution.

2. Polymers Used for the Examples

Polymer A: linear polyacrylamide, IV=9, 20% cationic charge. A copolymer of acrylamide with methyl chloride quaternary ammonium salt of dimethylaminoethyl acrylate (80/20 wt./wt.) of intrinsic viscosity above 9.0 dL/g.

Polymer B: Anionic branched copolymer of acrylamide with sodium acrylamide (60/40 wt./wt.) made with 3.5 to 5.0 ppm by weight methylene bis acrylamide branching agent as described in the invention. The product has a rheological oscillation value of tan delta at 0.005 Hz of 0.9.

The product is supplied as a mineral oil based dispersion with 50% actives.

Polymer C: Anionic, substantially linear copolymer of acrylamide with sodium acrylamide (60/40 wt./wt.) and an IV of 17 dL/g.

Polymer D: A 50% aqueous polyamine=poly(epichlorhydrindimethylamine) solution with 50% actives, 6-7.0 milleq/g, IV=0.2; GPC molecular weight 140.000

Polymer E: PolyDADMAC in aqueous solution with 20% actives and IV of 1.4 dL/g. 6.2 millieq/g.

Polymer F: linear polyacrylamide, IV=9, 22% cationic charge. A copolymer of acrylamide with methyl chloride quaternary ammonium salt of dimethylaminoethyl acrylate (78/22 wt./wt.) of intrinsic viscosity above 9.0 dL/g.

System A=Polymer A, added post screen

System B=Premix of 50% Polymer A and 50% Polymer D, added post screen

System C=Premix of 50% Polymer A and 50% Polymer E, added post screen

System D=Polymer A, added pre screen

System E=Premix of 50% Polymer A and 50% Polymer E, added pre screen

System F=Polymer F, added post screen

3. Paper Furnishes

Fine Paper Furnish

This alkaline, cellulosic fine paper suspension comprises solids, which are made up of about 90 weight % fibre and about 10% precipitated calcium carbonate filler (PCC). The PCC used is "Calopake F" in dry form from Specialty Minerals Lifford/UK. The employed fibre fraction is a 70/30 weight % blend of bleached birch and bleached pine, beaten to a Schopper Riegler freeness of 48° to provide enough fines for realistic testing conditions. The furnish is diluted with tap water to a consistency of about 0.61 weight %, comprising fines of about 18.3 weight %, split up into approximately 50% ash and 50% fibre fines. 0.5 kg/t polyaluminiumchloride (Alcofix 905) and 5 kg/t (on total solids) cationic starch (Raisamyl 50021) with a DS value of 0.035 based on dry weight is added to the paper stock. The pH of the fine paper furnish is 7.4±0.1, the conductivity about 500 μS/m and the zeta potential about −14.3 mV.

Mechanical Furnish 1

A peroxide bleached mechanical pulp of 60 Canadian standard freeness is supplemented with "Calopake F", a PCC in dry form from Specialty Minerals Lifford/UK to an ash content of about 20.6 weight % and diluted to a consistency of about 4.8 g/L, comprising fines of about 33.8 weight % according to Tappi Method T261, which the constituents of fines are approximately 54.5% ash and 45.5% fibre fines. The final furnish has a Schopper Riegler freeness of about 40°. 0.5 kg/t polyaluminiumchloride (Alcofix 905) and 5 kg/t (on total solids) cationic starch (Raisamyl 50021) with a DS value of 0.035 based on dry weight is added to the paper stock. The pH of the fine paper furnish is 7.4±0.1, the conductivity is about 500 μS/m and the zeta potential is about −23.5 mV.

Mechanical Furnish 2

A peroxide bleached mechanical pulp of 60 Canadian standard freeness is supplemented with precipitated calcium carbonate slurry (Omya F14960) to an ash content of about 10.2 weight % and diluted to a consistency of about 4.6 g/L, comprising fines of about 28 weight % according to Tappi Method T261, in which the fines are divided into approximately 35% ash and 65% fibre fines. 5 kg/t (on total solids) cationic starch (Raisamyl 50021) with a DS value of 0.035 based on dry weight is added to the paper stock. The pH of the final mechanical furnish is 7.5±0.1, the conductivity about 400 μS/m and the zeta potential about −30 mV.

Mechanical Furnish 3

A peroxide bleached mechanical pulp of 60 Canadian standard freeness is supplemented with precipitated calcium carbonate slurry (Omya F14960) to an ash content of about 21.8 weight % and diluted to a consistency of about 0.45 weight %, comprising fines of about 40 weight % according to Tappi Method T261, the fines containing approximately 56% ash and 44% fibre fines. 5 kg/t (on total solids) cationic starch (Raisamyl 50021) with a DS value of 0.035 based on dry weight is added to the paper stock. The pH of the final mechanical furnish is 7.5±0.1, the conductivity about 400 μS/m and the zeta potential about −31 mV.

Mechanical Furnish 4

An unbleached stone ground wood pulp is supplemented with precipitated calcium carbonate slurry (Omya F14960) to an ash content of about 42 weight % and diluted to a consistency of about 0.5 weight %, comprising fines of about 59.4 weight % according to Tappi Method T261, wherein approximately 70% ash and 30% fibre fines are included. The final furnish has a Schopper Riegler freeness of about 42°. 5 kg/t (on total solids) cationic starch (Raisamyl 50021) with a DS value of 0.035 based on dry weight is added to the paper stock. The pH of the final mechanical furnish is 7.1±0.1, the conductivity about 440 μS/m and the zeta potential about −43 mV.

SC Furnish 1

The cellulosic stock used to conduct the examples is typical wood containing paper furnish to make SC-paper. It consists of 18% deinked pulp, 21.5% unbleached stone ground wood and 50% mineral filler comprising 50% precipitated calcium carbonate (PCC) and 50% clay. The PCC is Omya F14960, an aqueous dispersion of precipitated calcium carbonate with 1% auxiliary substances for the use in SC paper. The Clay is Intramax SC Slurry from IMERYS. The final stock has a consistency of 0.75%, a total ash content of about 54%, a freeness of 69° SR (Schopper Riegler method), conductivity of 1800 μS/m and a fines content of 65% according to Tappi Method T261, wherein approximately 80% ash and 20% fibre fines are included. 2 kg/t (on total solids) cationic starch (Raisamyl 50021) with a DS value of 0.035 based on dry weight is added to the paper stock.

SC Furnish 2

The cellulosic stock with 50% ash content is made to 0.75% consistency according to furnish 1, except that another deinked pulp was used. The freeness is 64° SR, the fines content is 50 weight %.

Coated Magazine Furnish

This paper suspension for coated mechanical grades comprises solids, which are made up of about 87 weight % fibre and about 13% calcium carbonate filler. The employed fibre fraction comprises 50% bleached pressurised ground wood (BPGW), 28% kraft pulp and 22% coated broke. The stock consistency is about 0.68%.

4. First Pass Total and Ash Retention

Paper sheets of 19 $cm^2$ were made with a moving belt former by using 400-500 mL of paper stock depending on furnish type and consistency. The sheets are weighed in order to determine first pass total and ash retention using the following formula:

$$\text{FPTR [\%]} = \text{Sheet weight [g]} / \text{Total amount of paper stock based on dry weight [g]} * 100$$

$$\text{FPTAR [\%]} = \text{Ash content in sheet [g]} / \text{total amount of paper stock ash based on dry weight [g]} * 100$$

First pass total retention, for simplicity often referred to as total retention, is directly related to the basis weight. Analogue first pass ash retention, for simplicity often referred to as ash retention, is relative to total retention directly related to the sheet ash content. This is representative of the filler retention. In order to demonstrate the invention by means of realistic paper sheet compositions, the relationship between the effects of ash retention, total retention and total fines reduction are displayed as ash or total fines reduction over basis weight.

The Moving Belt Former (MBF) from the Helsinki University of Technology simulates the wet end part of a conventional fourdrinier machine (single wire machine) in laboratory scale and is used to make hand sheets. The pulp slurry is formed on a fabric, which is exactly the same used in commercial paper and board machines. A moving perforated cogged belt produces the scraping effect and pulsation, simulating water removal elements, foils and vacuum boxes, located in the wire section. There is a vacuum box under the cogged belt. The vacuum level, belt speed and effective suction time and other operating parameters are controlled by a computer system. Typical pulsation frequency range is 50-100 Hz and effective suction time ranges from 0 to 500 ms. On top of the wire is a mixing chamber similar to the Britt Jar where the furnish is sheared with a speed controlled propeller before draining it to form a sheet. A detailed description of the MBF is given in "Advanced wire part simulation with a moving belt former and its applicability in scale up on rotogravure printing paper", Strengell, K., Stenbacka, U., Ala-Nikkola, J. in Pulp & Paper Canada 105 (3) (2004), T62-66. The simulator is also described in greater detail in "Laboratory testing of retention and drainage", p. 87 in Leo Neimo (ed.), Papermaking Science and Technology, Part 4, Paper Chemistry, Fapet Oy, Jyväskyla 1999.

The retention and drainage chemicals are dosed into this mixing chamber as outlined in the protocol below (see table 1). It should be noted that the dosing protocols for Scanning Laser Microscopy and MBF experiments are the same in order to conjoin results from Schopper Riegler, Scanning Laser Microscopy and MBF.

TABLE 1

| Moving Belt Former<br>Computer controlled test protocol | |
|---|---|
| Time [seconds] | Action |
| 0 | Start with stirrer set at 1500 rpm |
| 12 | Add 1$^{st}$ retention aid |
| 30 | Stirrer at 500 rpm; add 2$^{nd}$ retention aid |
| 45 | Stirrer at 1500 rpm |
| 75 | Start drainage to from a sheet |

5. SLM (Scanning Laser Microscopy)

The scanning laser microscopy, often referred to as FBRM (focused beam laser reflectance measurement), employed in the following examples is a real time particle size distribution measurement and outlined in U.S. Pat. No. 4,871,251, issued to Preikschat, F. K. and E. (1989). It consists of a 780 nm focused, rotating laser beam that is scanned thru suspension of interest at 2-4 m/s velocity. Particles and flocs are crossed by the laser beam and reflect some of the light back to the probe. The duration time of light reflection is detected and transformed into a chord length [m/s*s=m]. Measurements are not influenced by sample flow velocities <1800 rpm, since scanning velocity of the laser is much faster than the mixing velocity. Backscattered light pulses are used to form a histogram of 90 log particle size channels between 0.8 and 1000 micrometer with particle number/time over chord length. The raw data can be presented in different ways such as number of particles or chord length over time. Mean, Median and their derivates as well as various particle size ranges can be selected to describe the observed process. Commercial instruments are available under trade name "Lasentec FBRM" from Mettler Toledo, Switzerland. Further information about using SLM for monitoring flocculation can be found in "Flocculation monitoring: focused beam reflectance measurement as measurement tool", Blanco, A., Fuente, E., Negro, C., Tijero, C. in Canadian Journal of Chemical Engineering (229), 80(4), 734-740. Publisher: Canadian Society for Chemical Engineering. Further details are available in "Focused Beam Reflectance measurement as a toll to measure flocculation". Blanco, A.; Fuente, E.; Negro, C.; Monte, C.; Tijero, J. Chemical Engineering Department of Chemistry. Complutense University of Madrid, Madrid, Spain. Papermakers Conference, Cincinnati, Ohio, United States, Mar. 11-14, 2001, p. 114-126. Publisher: Tappi Press, Atlanta, Ga., CODEN:69BXON Conference;

The objective of SLM experiments in this invention is determining the removal of fines and colloidal material during the flocculation process since it gives good correlation to ash retention. In this regard it is of particular interest to know the amount of fines and colloidal removal under dynamic shear conditions at the end of the laboratory experiment that is to say at the time where sheet building starts. In accordance to the protocol this time point is 75 seconds. The fines and colloidal retention is measured as [%] of total fines removal from the initial position. FIG. 1 illustrates this principle by plotting the number of fine and colloidal particulates between 0.8 and 10 microns against the running of the experiment. The greater the total fines reduction (=TFR value) the better the colloidal and fines retention during the flocculation process.

The TFR value is calculated as following:

$$TFR = \frac{\text{Counts}/second_{t-0s} - \text{Counts}/second_{t-75s}}{\text{Counts}/second_{t-0s}} * 100$$

The experiment itself consists of taking 500 mL of paper stock and placing this in the appropriate mixing beaker. The furnish is stirred and sheared with a variable speed motor and a propeller similar to as a standard Britt Jar set up. The applied dosing sequence is same as used for the moving belt former and shown below (see table 2). It should be noted that, for better understanding, the TFR number can also have a minus sign, for instance when pre agglomerated filler particles break lose under the applied shear. Filler particles are usually pre agglomerated by the addition of cationic starch or alum to the thick stock prior to the actual retention system.

TABLE 2

| Scanning Laser Microscopy<br>Test protocol | |
|---|---|
| Time [seconds] | Action |
| 0 | Start with stirrer set at 1500 rpm |
| 12 | Add 1$^{st}$ retention aid |
| 30 | Set stirrer at 500 rpm; add 2$^{nd}$ retention aid |
| 45 | Set stirrer at 1500 rpm |
| 75 | Stop experiment |

Example I

Fine Paper Furnish with Systems A and B

This example demonstrates the invention in a chemical pulp furnish. The addition of a water soluble, anionic, first polymeric retention aid (polymer B) mechanically degrading the flocs, reflocculating the suspension by adding a solution of a water soluble, cationic, second retention aid (systems A or B) increases the ash content in the sheet at a given basis weight (see tables 1.1-3 as well as FIGS. 2 and 3). This has the benefit of allowing paper sheets to contain higher level of filler and a reduced level of fibres. It also allows the papermaker to produce a certain basis weight having a higher filler level without adjusting the thin stock towards higher ash loadings. It should be noted that higher ash loadings result in lower total retention in which event the thin stock consistency has to be increased to compensate for this effect. In turn, high thin stock consistencies combined with low retention often negatively impact sheet forming, system cleanliness, runnability and sheet properties such as dusting and strength.

TABLE I.1

No addition of polymer B, dosage of system A = variable

| Dosage of System A [g/t] | First Pass Total Retention [%] | First Pass Total Ash Retention [%] | Ash content in sheet [%] | Basis weight [g/m$^2$] |
|---|---|---|---|---|
| 200 | 91.4 | 64.9 | 7.1 | 81.9 |
| 400 | 90.3 | 65.5 | 7.3 | 80.9 |
| 600 | 93.9 | 68.8 | 7.3 | 84.2 |
| 800 | 96.0 | 72.9 | 7.6 | 86.1 |
| 1000 | 96.4 | 75.7 | 7.9 | 86.4 |
| 1500 | 97.0 | 71.8 | 7.4 | 86.9 |

TABLE I.2

250 g/t of polymer B = const., dosage of system A = variable

| Dosage of System A [g/t] | First Pass Total Retention [%] | First Pass Total Ash Retention [%] | Ash content in sheet [%] | Basis weight [g/m$^2$] |
|---|---|---|---|---|
| 200 | 86.3 | 88.7 | 9.2 | 86.3 |
| 400 | 86.9 | 79.8 | 8.2 | 86.9 |
| 600 | 86.1 | 79.9 | 8.3 | 86.1 |
| 800 | 85.8 | 80.2 | 8.4 | 85.8 |
| 1000 | 86.9 | 83.3 | 8.6 | 86.9 |

TABLE I.3

No addition of polymer B, dosage of system B = variable

| Dosage of System B [g/t] | First Pass Total Retention [%] | First Pass Total Ash Retention [%] | Ash content in sheet [%] | Basis weight [g/m$^2$] |
|---|---|---|---|---|
| 400 | 92.9 | 66.9 | 7.2 | 83.2 |
| 600 | 93.1 | 63.6 | 6.8 | 83.5 |
| 800 | 94.0 | 64.5 | 6.9 | 84.2 |
| 1000 | 93.6 | 67.8 | 7.2 | 83.9 |
| 2000 | 95.4 | 65.7 | 6.9 | 85.5 |
| 2500 | 95.5 | 64.9 | 6.8 | 85.5 |

TABLE I.4

250 g/t of polymer B = const., dosage of system B = variable

| Dosage of System B [g/t] | First Pass Total Retention [%] | First Pass Total Ash Retention [%] | Ash content in sheet [%] | Basis weight [g/m$^2$] |
|---|---|---|---|---|
| 50 | 96.6 | 70.1 | 7.3 | 86.5 |
| 100 | 95.5 | 70.4 | 7.4 | 85.6 |
| 400 | 95.7 | 76.5 | 8.0 | 85.7 |
| 600 | 93.6 | 72.1 | 7.7 | 83.9 |
| 800 | 93.1 | 75.8 | 8.1 | 83.5 |
| 1000 | 95.7 | 77.7 | 8.1 | 85.8 |

Example II

Mechanical Furnish 1 with System A

The mechanical furnish in this example is similarly prepared to the fine paper furnish in example I in terms of PAC and starch addition. It appears that the novel flocculating system (polymer B pre screen+system A post screen) significantly increases ash retention relative to total retention. Thus the process provides means for incorporating more filler into the paper sheet (see tables II.1, II.2 and FIG. 5). The preferred ash retention is confirmed by an increased reduction of fine particulate material between 0.8 and 10 microns (see tables II.1, II.2 and FIG. 2). The dosage of total actives to achieve a certain ash level relative to basis weight is also reduced with the present process.

TABLE II.1

No addition of polymer B, dosage of system A = variable

| Dosage of System A [g/t] | First Pass Total Retention [%] | First Pass Total Ash Retention [%] | Ash content in sheet [%] | Basis weight [g/m$^2$] | Total fines reduction [%] |
|---|---|---|---|---|---|
| 200 | 73.2 | 29.9 | 8.4 | 51.6 | 10.7 |
| 400 | 75.3 | 40.4 | 11.0 | 53.1 | 25.3 |
| 600 | 76.0 | 46.1 | 12.5 | 53.6 | 32.3 |

TABLE II.2

250 g/t of polymer B = const., dosage of system A = variable

| Dosage of System A [g/t] | First Pass Total Retention [%] | First Pass Total Ash Retention [%] | Ash content in sheet [%] | Basis weight [g/m$^2$] | Total fines reduction [%] |
|---|---|---|---|---|---|
| 100 | 72.6 | 36.8 | 10.4 | 51.2 | 33.9 |
| 200 | 73.6 | 44.9 | 12.5 | 51.9 | 42.1 |
| 400 | 76.6 | 50.2 | 13.5 | 54.0 | 51.2 |

Example III

Mechanical Furnish 2 with Systems A and B

The purpose of this example is to show that the present process is also able to increase ash level relative to basis weight in furnishes containing anionically dispersed filler. Both systems A and B in conjunction with the anionic branched polymer B provide paper sheets with significantly increased ash levels relative to basis weight (see tables III.1-4 and FIGS. 8 and 9). The effect is also expressed as improved total fines reduction relative to basis weight (see tables III.1-4 as well as FIGS. 6 and 7). Thus it enables the paper sheet to contain higher amounts of filler and a reduced level of fibre at a high total retention. Furthermore the overall dosage of polymer B in conjunction with system B in terms of ash retention is reduced by comparison to the system B alone as prior art process (see tables III.3 and III.4).

TABLE III.1

No addition of polymer B, dosage of system A = variable

| Dosage of System A [g/t] | First Pass Total Retention [%] | First Pass Total Ash Retention [%] | Ash content in sheet [%] | Basis weight [g/m$^2$] | Total fines reduction [%] |
|---|---|---|---|---|---|
| 200 | 82.0 | 34.1 | 4.2 | 55.4 | −7.2 |
| 400 | 85.9 | 51.7 | 6.1 | 58.1 | 11.6 |
| 600 | 87.9 | 62.2 | 7.2 | 59.4 | 28.8 |
| 800 | 90.2 | 63.6 | 7.2 | 61.0 | 33.5 |
| 1200 | 90.4 | 74.8 | 8.4 | 61.1 | 32.5 |

TABLE III.2

250 g/t of polymer B = const., dosage of system A = variable

| Dosage of System A [g/t] | First Pass Total Retention [%] | First Pass Total Ash Retention [%] | Ash content in sheet [%] | Basis weight [g/m$^2$] | Total fines reduction [%] |
|---|---|---|---|---|---|
| 200 | 83.0 | 49.4 | 6.1 | 56.1 | 9.0 |
| 400 | 85.7 | 56.5 | 6.7 | 57.9 | 21.0 |
| 600 | 86.9 | 62.1 | 7.3 | 58.7 | 21.3 |
| 800 | 88.0 | 67.2 | 7.8 | 59.5 | 36.1 |

TABLE III.3

No addition of polymer B, dosage of system B = variable

| Dosage of System B [g/t] | First Pass Total Retention [%] | First Pass Total Ash Retention [%] | Ash content in sheet [%] | Basis weight [g/m$^2$] | Total fines reduction [%] |
|---|---|---|---|---|---|
| 400 | 83.4 | 39.3 | 4.8 | 56.4 | −0.3 |
| 600 | 84.8 | 46.0 | 5.5 | 57.3 | 8.8 |
| 800 | 85.7 | 50.8 | 6.1 | 57.9 | 16.4 |
| 1000 | 87.1 | 52.0 | 6.1 | 58.8 | 20.1 |
| 1600 | 89.3 | 63.1 | 7.2 | 60.4 | 30.2 |

TABLE III.4

250 g/t polymer B = const., dosage of system B = variable

| Dosage of System B [g/t] | First Pass Total Retention [%] | First Pass Total Ash Retention [%] | Ash content in sheet [%] | Basis weight [g/m$^2$] | Total fines reduction [%] |
|---|---|---|---|---|---|
| 200 | 80.3 | 41.1 | 5.2 | 54.3 | 3.4 |
| 400 | 85.5 | 54.9 | 6.5 | 57.8 | 21.2 |
| 600 | 86.9 | 64.8 | 7.6 | 58.7 | 23.2 |
| 800 | 89.1 | 69.4 | 7.9 | 60.2 | 34.9 |

Example IV

Mechanical Furnish 3 with Systems A, C, D and E

We also find that the novel process, wherein the anionic branched polymer is present in the thick or thin stock prior to the addition of the cationic flocculant or cat/cat system, functions in mechanical furnishes with elevated ash levels in the thin stock, for instance with 20% filler. This circumstance is illustrated by means of system A and C in conjunction with polymer B. System A represents a standard high molecular weight retention aid on acrylamide basis, whereas system C is a typical cat/cat system comprising a high molecular weight flocculant and a low molecular weight polyDADMAC coagulant. This example could for instance model a system for improved newsprint, where both systems are commonly used (see tables IV.1+2, IV.4+5 and FIGS. 10-12). The incorporation of more filler in the sheet is for instance useful to improve opacity, whiteness and printability.

In this particular furnish the reverse order of addition (system D and E), wherein the cationic retention system is added prior to the anionic branched polymer, does not achieve equal ash levels relative to basis weight compared to the invention process (systems A and C). So we find that the present process provides particularly good results in mechanical furnishes (see tables IV.1-6 and FIGS. 10-12).

TABLE IV.1

No addition of polymer B, dosage of system A = variable

| Dosage of System A [g/t] | First Pass Total Retention [%] | First Pass Total Ash Retention [%] | Ash content in sheet [%] | Basis weight [g/m$^2$] |
|---|---|---|---|---|
| 200 | 71.2 | 23.1 | 7.1 | 47.1 |
| 400 | 73.8 | 36.2 | 10.7 | 48.8 |
| 600 | 77.8 | 41.6 | 11.7 | 51.4 |
| 800 | 79.7 | 48.1 | 13.2 | 52.7 |
| 1200 | 82.1 | 59.1 | 15.7 | 54.3 |

TABLE IV.2

250 g/t of polymer B = const., dosage of system A = variable

| Dosage of System A [g/t] | First Pass Total Retention [%] | First Pass Total Ash Retention [%] | Ash content in sheet [%] | Basis weight [g/m$^2$] |
|---|---|---|---|---|
| 200 | 72.7 | 32.0 | 9.6 | 48.0 |
| 400 | 74.6 | 40.1 | 11.7 | 49.3 |
| 600 | 77.4 | 47.5 | 13.4 | 51.2 |
| 800 | 78.9 | 53.2 | 14.7 | 52.2 |

TABLE IV.3

250 g/t of polymer B = const., dosage of system D = variable

| Dosage of System D [g/t] | First Pass Total Retention [%] | First Pass Total Ash Retention [%] | Ash content in sheet [%] | Basis weight [g/m$^2$] |
|---|---|---|---|---|
| 200 | 73.0 | 30.0 | 8.9 | 48.3 |
| 400 | 77.7 | 42.4 | 11.9 | 51.3 |
| 600 | 78.9 | 48.3 | 13.3 | 52.2 |
| 800 | 79.4 | 48.9 | 13.4 | 52.5 |

TABLE IV.4

No addition of polymer B, dosage of system C = variable

| Dosage of System C [g/t] | First Pass Total Retention [%] | First Pass Total Ash Retention [%] | Ash content in sheet [%] | Basis weight [g/m$^2$] | Total fines reduction [%] |
|---|---|---|---|---|---|
| 200 | 68.2 | 15.4 | 4.9 | 45.1 | −11.7 |
| 400 | 70.8 | 22.5 | 6.9 | 46.8 | −11.7 |
| 600 | 71.8 | 22.4 | 6.8 | 47.5 | −9.5 |
| 800 | 74.2 | 33.0 | 9.7 | 49.0 | 3.3 |
| 1000 | 73.7 | 33.8 | 10.0 | 48.7 | 2.6 |
| 1200 | 76.1 | 37.9 | 10.9 | 50.3 | 9.5 |

TABLE IV.5

250 g/t of polymer B = const., dosage of system C = variable

| Dosage of System C [g/t] | First Pass Total Retention [%] | First Pass Total Ash Retention [%] | Ash content in sheet [%] | Basis weight [g/m$^2$] | Total fines reduction [%] |
|---|---|---|---|---|---|
| 200 | 72.3 | 33.3 | 10.0 | 47.8 | 13.7 |
| 400 | 75.3 | 36.1 | 10.4 | 49.8 | 16.7 |
| 600 | 77.8 | 47.0 | 13.2 | 51.4 | 26.8 |
| 800 | 77.7 | 50.2 | 14.1 | 51.3 | 25.2 |
| 1000 | 79.3 | 51.2 | 14.1 | 52.4 | 32.5 |

TABLE IV.6

250 g/t of polymer B = const., dosage of system E = variable

| Dosage of System E [g/t] | First Pass Total Retention [%] | First Pass Total Ash Retention [%] | Ash content in sheet [%] | Basis weight [g/m$^2$] | Total fines reduction [%] |
|---|---|---|---|---|---|
| 200 | 75.9 | 35.1 | 10.1 | 50.2 | 5.8 |
| 400 | 78.3 | 42.6 | 11.8 | 51.8 | 12.0 |
| 600 | 80.5 | 47.1 | 12.8 | 53.2 | 24.1 |
| 800 | 80.3 | 49.4 | 13.4 | 53.1 | 29.9 |
| 1000 | 81.7 | 58.0 | 15.5 | 54.0 | 19.6 |

Example V

Mechanical Furnish 4 with Systems A and B

By means of example V we can also show that the invention process works in highly filled mechanical paper grades, where for instance more than 40% by weight filler is present in the thin stock. Both system A and B show significantly increased sheet ash contents relative to basis weight as well as a substantial increased total fines reduction in the range between 0.8 and 10 microns (see tables V.1-4 and FIGS. 13-16). The addition of the anionic branched polymer B prior to system A increases the ash level in such a way from about 25 to about 27.5% filler by weight for a 55 g/m$^2$ sheet compared to system A alone (see FIG. 15). In addition polymer B provides an amendment for system B from about 19 to about 23% filler by weight for a 50 g/m$^2$ sheet (see FIG. 16). This particular application of the invention in highly filled mechanical furnishes is for instance useful for producing LWC or SC paper grades.

TABLE V.1

No addition of polymers B, dosage of system A = variable

| Dosage of System A [g/t] | First Pass Total Retention [%] | First Pass Total Ash Retention [%] | Ash content in sheet [%] | Basis weight [g/m2] | Total fines reduction [%] |
|---|---|---|---|---|---|
| 200 | 45.0 | 7.6 | 7.1 | 41.4 | −4.8 |
| 400 | 48.5 | 15.9 | 13.8 | 44.5 | −4.2 |
| 600 | 51.7 | 20.7 | 16.8 | 47.5 | 5.0 |
| 800 | 56.9 | 29.9 | 22.1 | 52.2 | 11.1 |
| 1200 | 64.0 | 44.0 | 28.9 | 58.7 | 23.9 |

TABLE V.2

250 g/t polymer B = const., dosage of system A = variable

| Dosage of System A [g/t] | First Pass Total Retention [%] | First Pass Total Ash Retention [%] | Ash content in sheet [%] | Basis weight [g/m2] | Total fines reduction [%] |
|---|---|---|---|---|---|
| 200 | 54.6 | 31.4 | 24.2 | 50.1 | 15.4 |
| 400 | 56.8 | 35.6 | 26.3 | 52.2 | 21.6 |
| 600 | 60.2 | 41.3 | 28.8 | 55.3 | 32.7 |
| 800 | 59.9 | 38.1 | 26.7 | 55.0 | 36.4 |

TABLE V.3

No addition of polymer B, dosage of system B = variable

| Dosage of System B [g/t] | First Pass Total Retention [%] | First Pass Total Ash Retention [%] | Ash content in sheet [%] | Basis weight [g/m2] | Total fines reduction [%] |
|---|---|---|---|---|---|
| 400 | 47.0 | 10.1 | 9.1 | 43.1 | −3.5 |
| 600 | 48.6 | 16.0 | 13.8 | 44.7 | −4.8 |
| 800 | 52.8 | 23.6 | 18.8 | 48.4 | −0.5 |
| 1000 | 57.0 | 28.0 | 20.6 | 52.3 | 5.1 |
| 1600 | 66.4 | 49.9 | 31.6 | 60.9 | 23.0 |

TABLE V.4

250 g/t polymer B = const., dosage of system B = variable

| Dosage of System B [g/t] | First Pass Total Retention [%] | First Pass Total Ash Retention [%] | Ash content in sheet [%] | Basis weight [g/m2] | Total fines reduction [%] |
|---|---|---|---|---|---|
| 200 | 52.9 | 27.7 | 22.0 | 48.6 | 9.6 |
| 400 | 55.2 | 31.5 | 24.0 | 50.7 | 16.3 |
| 800 | 59.4 | 38.9 | 27.5 | 54.5 | 18.1 |

Example VI

SC Furnish 1 with Systems A and C

Example VI illustrates the invention for a preferred SC paper composition, characterised in that the fibre fraction contains deinked, mechanical and chemical pulp as well PCC and clay. It becomes apparent from FIG. 17 that the invention process clearly increases the sheet ash level compared to system A alone. So the ash level changes from about 31% by weight filler to about 33% by weight filler for a 63 g/m$^2$ sheet (see FIG. 17). When making mechanical paper, especially SC paper, a preferred system would employ a polyDADMAC as the cationic component especially when it is used in conjunction with a high molecular weight cationic polymer in a cat/cat system. This preferred form of the invention is shown with FIG. 18, wherein the polyDADMAC containing cat/cat system C is operated with and without polymer B prior to system C. The present invention process substantially increases the ash level in the sheet relative to the basis weight and brings in such a way about an improvement of 3.5% by weight of filler for a 61 g/m$^2$ sheet. Furthermore the dosage of system A and C, as well as the overall polymer dose for both systems is reduced by adding the branched anionic polymer with special rheological characteristics (see tables VI.1.4).

TABLE VI.1

No addition of polymers B, dosage of system A = variable

| Dosage of System A [g/t] | First Pass Total Retention [%] | First Pass Total Ash Retention [%] | Ash content in sheet [%] | Basis weight [g/m$^2$] |
|---|---|---|---|---|
| 400 | 55.1 | 29.4 | 28.8 | 60.8 |
| 600 | 58.2 | 35.8 | 33.2 | 64.2 |
| 800 | 62.4 | 41.9 | 36.2 | 68.8 |
| 1000 | 64.2 | 44.3 | 37.2 | 70.7 |

TABLE VI.2

250 g/t polymer B = const., dosage of system A = variable

| Dosage of System A [g/t] | First Pass Total Retention [%] | First Pass Total Ash Retention [%] | Ash content in sheet [%] | Basis weight [g/m$^2$] |
|---|---|---|---|---|
| 150 | 53.3 | 28.7 | 29.0 | 58.8 |
| 200 | 54.9 | 30.9 | 30.4 | 60.5 |
| 250 | 55.1 | 31.8 | 31.2 | 60.7 |
| 300 | 57.3 | 33.9 | 31.9 | 63.2 |
| 350 | 56.9 | 34.4 | 32.7 | 62.7 |
| 400 | 57.4 | 37.3 | 35.1 | 63.2 |

TABLE VI.3

No addition of polymer B, dosage of system C = variable

| Dosage of System C [g/t] | First Pass Total Retention [%] | First Pass Total Ash Retention [%] | Ash content in sheet [%] | Basis weight [g/m$^2$] | Total fines reduction [%] |
|---|---|---|---|---|---|
| 600 | 54.8 | 29.9 | 29.4 | 60.4 | 28.9 |
| 800 | 57.5 | 33.5 | 31.5 | 63.3 | 32.8 |
| 1000 | 59.9 | 38.5 | 34.7 | 66.0 | 37.1 |

TABLE VI.4

250 g/t polymer B = const., dosage of system C = variable

| Dosage of System C [g/t] | First Pass Total Retention [%] | First Pass Total Ash Retention [%] | Ash content in sheet [%] | Basis weight [g/m$^2$] | Total fines reduction [%] |
|---|---|---|---|---|---|
| 300 | 51.7 | 29.6 | 30.9 | 57.0 | 34.0 |
| 400 | 54.3 | 33.0 | 32.8 | 59.9 | 36.9 |
| 500 | 55.2 | 33.9 | 33.2 | 60.8 | 40.3 |
| 600 | 56.5 | 36.2 | 34.6 | 62.3 | 42.2 |
| 700 | 56.8 | 35.9 | 34.2 | 62.6 | 44.6 |

Example VII

SC Furnish 2 with Systems B and C

In example VII demonstrates the difference in performance between a branched anionic and substantially linear anionic polymer added prior to cationic retention systems in terms ash retention relative to total retention. It appears that polymer A, a linear unbranched anionic polymer added prior to system C, does not have the ability to increase total fines reduction, respectively the ash level relative to basis weight (see tables VII.3 and 4 as well as FIGS. 19 and 20). In contrast polymer B in conjunction with system B increases ash retention relative to total retention, the relative level of fibre retention will tend to be reduced. This has the benefit of allowing paper sheets to contain a higher level of filler and a reduced level of fibre. This brings about significant commercial and quality advantages since fibre is often more expensive than the filler and whiteness, opacity and printability of the paper is improved. Furthermore machine runnability and paper quality due to system cleanliness and headbox consistency is not sacrificed.

TABLE VII.1

No addition of polymer B, dosage of system B = variable

| Dosage of System B [g/t] | First Pass Total Retention [%] | First Pass Total Ash Retention [%] | Ash content in sheet [%] | Basis weight [g/m$^2$] |
|---|---|---|---|---|
| 600 | 50.7 | 24.2 | 23.8 | 55.8 |
| 650 | 52.3 | 28.7 | 27.5 | 57.6 |
| 700 | 50.9 | 27.5 | 27.0 | 56.1 |
| 750 | 51.7 | 27.6 | 26.7 | 56.9 |
| 1000 | 56.6 | 33.1 | 29.2 | 62.4 |

TABLE VII.2

250 g/t polymer B = const., dosage of system B = variable

| Dosage of System B [g/t] | First Pass Total Retention [%] | First Pass Total Ash Retention [%] | Ash content in sheet [%] | Basis weight [g/m$^2$] |
|---|---|---|---|---|
| 200 | 51.4 | 29.4 | 28.6 | 56.6 |
| 300 | 52.6 | 30.7 | 29.2 | 57.9 |
| 400 | 55.4 | 33.4 | 30.2 | 61.0 |
| 500 | 55.1 | 32.5 | 29.4 | 60.7 |
| 800 | 58.7 | 40.1 | 34.1 | 64.7 |

TABLE VII.3

No addition of polymer C, dosage of system C = variable

| Dosage of System C [g/t] | First Pass Total Retention [%] | First Pass Total Ash Retention [%] | Ash content in sheet [%] | Basis weight [g/m$^2$] | Total fines reduction [%] |
|---|---|---|---|---|---|
| 600 | 51.7 | 27.4 | 26.5 | 57.0 | 25.8 |
| 800 | 54.7 | 32.1 | 29.3 | 60.3 | 31.7 |
| 1000 | 55.7 | 32.4 | 29.1 | 61.3 | 35.9 |
| 1200 | 57.3 | 37.1 | 32.4 | 63.2 | 42.8 |

TABLE VII.4

250 g/t polymer C = const., dosage of system C = variable

| Dosage of System C [g/t] | First Pass Total Retention [%] | First Pass Total Ash Retention [%] | Ash content in sheet [%] | Basis weight [g/m$^2$] | Total fines reduction [%] |
|---|---|---|---|---|---|
| 300 | 53.9 | 32.0 | 29.7 | 59.4 | 37.7 |
| 500 | 58.1 | 38.6 | 33.2 | 64.1 | 41.4 |
| 700 | 59.1 | 40.6 | 34.3 | 65.1 | 48.7 |
| 900 | 59.2 | 38.8 | 32.8 | 65.2 | 52.9 |

Example VIII

Coated Magazine Furnish with System F

The single flocculant system F is compared with and without the addition of the anionic branched polymer B pre screen in a mill furnish for coated magazine paper. It becomes apparent that the invention process provides significant higher ash retention relative to a total retention of about 68.2 to 68.4% (see tables VIII.1 and 2). From this it follows that the invention process also works in mechanical furnishes comprising coated broke.

TABLE VIII.1

| No addition of polymer B | | |
|---|---|---|
| Dosage of System F [g/t] | First Pass Total Retention [%] | First Pass Total Ash Retention [%] |
| 300 | 68.4 | 28.2 |

TABLE VIII.2

| 100 g/t polymer B = const. | | |
|---|---|---|
| Dosage of System F [g/t] | First Pass Total Retention [%] | First Pass Total Ash Retention [%] |
| 300 | 68.2 | 44.3 |

The invention claimed is:

1. A process of making paper or paperboard with improved ash retention relative to a total retention using a polymeric retention/drainage system comprising the steps of:

providing a thick stock cellulosic suspension that contains filler;

diluting the thick stock cellulosic suspension to form a thin stock suspension;

wherein the filler is present in the thin stock suspension in an amount of at least 10% by weight based on a dry weight of the thin stock suspension;

flocculating the thin stock cellulosic suspension by adding a polymeric retention/drainage system;

draining the thin stock suspension on a screen to form a sheet; and then drying the sheet, thereby making paper or paperboard, wherein the polymeric retention/drainage system comprises, i) a water-soluble branched anionic polymer; and ii) a water-soluble cationic or amphoteric polymer;

wherein the anionic polymer is present in the thick stock or thin stock suspension prior to the addition of the cationic or amphoteric polymer.

2. The process according to claim 1, in which the water-soluble cationic or amphoteric polymer is a natural polymer or a synthetic polymer that has an intrinsic viscosity of at least 1.5 dl/g.

3. The process according to claim 1, in which the water-soluble cationic or amphoteric polymer is a cationic starch, amphoteric starch, or a synthetic polymer selected from the group consisting of cationic or amphoteric polyacrylamides, polyvinyl amines, and polymers of diallyl dimethyl ammonium chloride.

4. The process according to claim 1, in which the water-soluble cationic or amphoteric polymer; and the cationic coagulant are added to the thick stock cellulosic suspension as a blend.

5. The process according to claim 1, in which the water-soluble branched anionic polymer has:

(a) an intrinsic viscosity above 1.5 dL/g and/or saline Brookfield viscosity of above about 2.0 mPa·s; and (b) a rheological oscillation value of tan delta at 0.005 Hz of above 0.7; and/or (c) a deionised SLV viscosity number which is at least three times a salted SLV viscosity number of a corresponding unbranched polymer made in the absence of a branching agent.

6. The process according to claim 1, in which the thick stock cellulosic suspension containing the water-soluble anionic branched polymer is subjected to at least one stage that brings about mechanical degradation prior to an addition of the water-soluble cationic or amphoteric polymer, and wherein the water-soluble cationic polymer and cationic coagulant are added as a blend.

7. The process according to claim 1, wherein the flocculating step comprises adding the water-soluble anionic branched polymer to the thin stock; shearing the thin stock containing the water-soluble branched anionic polymer using a centriscreen; and adding the water-soluble cationic or amphoteric polymer; and the water-soluble cationic polymer and cationic coagulant are added as a blend to the thick stock cellulosic suspension after the centriscreen sheering step.

8. The process according to claim 1, in which the paper or paperboard made is super calendared paper (SC-paper).

9. The process according to claim 1, in which the thick stock cellulosic suspension comprises a mechanical pulp and said mechanical pulp is selected from the group consisting of stone-ground wood (SGW), thermomechanical pulp (TMP), chemithermomechanical pulp (CTMP), bleached Chemi-Thermo Mechanical Pulp (BCTMP), and mixtures thereof.

10. The process according to claim 1, in which there is a mechanical fibre content of between 10 and 75% by the dry weight of the thick stock cellulosic suspension.

11. The process according to claim 1, in which filler is present in the thin stock suspension in an amount of at least 10% by weight based on a dry weight of the thin stock suspension.

12. The process according to claim 1, in which the filler is selected from the group consisting of calcium carbonate, titanium dioxide, and kaolin.

13. The process according to claim 1, in which the filler present in the thick stock cellulosic suspension prior to draining is at least 30% by weight based on a dry weight of the thick stock cellulosic suspension.

14. The process according to claim 1, which process is carried out on a GAP former paper machine.

15. A process of making paper or paperboard with improved ash retention relative to a total retention using a polymeric retention/drainage system comprising the steps of:

providing a thick stock cellulosic suspension that contains filler;

diluting the thick stock cellulosic suspension to form a thin stock suspension;

wherein the filler is present in the thin stock suspension in an amount of at least 10% by weight based on a dry weight of the thin stock suspension;

flocculating the thin stock the thin stock cellulosic suspension by adding the polymeric retention/drainage system;

draining the thin stock suspension on a screen to form a sheet; and then drying the sheet, thereby making paper or paperboard, wherein the polymeric retention/drainage system comprises, i) a water-soluble branched anionic polymer;

ii) a water-soluble cationic or amphoteric polymer; and iii) a cationic coagulant from 0.2 to 0.5% by weight of a cellulosic fibre, wherein the cationic coagulant is a synthetic polymer of intrinsic viscosity up to 3 dl/g and exhibiting a cationic charge density of greater than 3 meq/g, wherein the anionic polymer is present in the thick stock or thin stock suspension prior to the addition of the cationic or amphoteric polymer.

16. A process of making paper or paperboard with improved ash retention relative to a total retention using a polymeric retention/drainage system comprising the steps of:

providing a thick stock cellulosic suspension that contains mechanical pulp and filler;

diluting the thick stock suspension to form a thin stock suspension, wherein the filler is present in the thin stock suspension in an amount of at least 10% by weight based on a dry weight of the thin stock suspension;

flocculating the thin stock solution and/or thick stock cellulosic suspension the thin stock cellulosic suspension by adding the polymeric retention/drainage system;

draining the thin stock suspension on a screen to form a sheet; and then drying the sheet, wherein the polymeric retention/drainage system comprises, i) a water-soluble branched anionic polymer; and ii) a water-soluble cationic or amphoteric polymer, wherein the anionic polymer is present in the thick stock cellulosic suspension or thin stock suspension prior to the addition of the water-soluble cationic or amphoteric polymer, and wherein the process for making paper or paperboard excludes clay.

* * * * *